United States Patent [19]

Werding

[11] 4,260,110

[45] Apr. 7, 1981

[54] SPRAY NOZZLE, DEVICES CONTAINING THE SAME AND APPARATUS FOR MAKING SUCH DEVICES

[76] Inventor: Winfried Werding, Grand-Rue 10, Pully, Switzerland, CH 1009

[21] Appl. No.: 909,995

[22] Filed: May 26, 1978

[30] Foreign Application Priority Data

| | | | |
|---|---|---|---|
| Aug. 2, 1977 | [CH] | Switzerland | 9607/77 |
| Oct. 14, 1977 | [CA] | Canada | 288724 |
| Feb. 24, 1978 | [CH] | Switzerland | 2024/77 |

[51] Int. Cl.[3] ..... B05B 1/34; B05B 7/10

[52] U.S. Cl. ..... 239/404; 239/466; 239/492

[58] Field of Search ..... 222/95, 386.5, 399, 222/402.1, 105; 239/307, 308, 327, 402, 404, 466, 491–497

[56] References Cited

U.S. PATENT DOCUMENTS

| | | | |
|---|---|---|---|
| 2,219,178 | 10/1940 | Eagle | 222/399 |
| 2,503,481 | 4/1950 | Hallinan | 239/466 X |
| 2,974,880 | 3/1961 | Stewart et al. | 239/493 |
| 3,169,670 | 2/1965 | Hrebenak et al. | 222/95 |
| 3,692,245 | 9/1972 | Needham et al. | 239/494 X |
| 3,881,658 | 5/1975 | Greenebaum et al. | 239/492 |
| 4,071,196 | 1/1978 | Burke et al. | 239/492 |

FOREIGN PATENT DOCUMENTS

| | | | |
|---|---|---|---|
| 320567 | 10/1929 | United Kingdom | 239/493 |

*Primary Examiner*—Andres Kashnikow
*Attorney, Agent, or Firm*—Heinrich W. Herzfeld

[57] ABSTRACT

A spray nozzle comprises, in a housing, a hollow nozzle interior comprising a discharge chamber containing a nozzle outlet and, as a first stage of turbulence, an annular chamber coaxially about the central axis of the nozzle outlet, and feed channels which lead from the annular chamber at least approximately tangentially to the periphery of the discharge chamber, and supply duct means for feeding liquid to the first stage of turbulence comprising feed channels feeding liquid tangentially. The hollow nozzle interior further comprises at least one additional stage of turbulence, and between two successive stages of turbulence, at least one obstacle breaking up the liquid flowing from the upstream to the downstream stage of turbulence and deflecting the liquid out of the flow plane through the annular chamber towards the side of the nozzle outlet by an angle of maximally 90°.

29 Claims, 42 Drawing Figures

Fig. 1
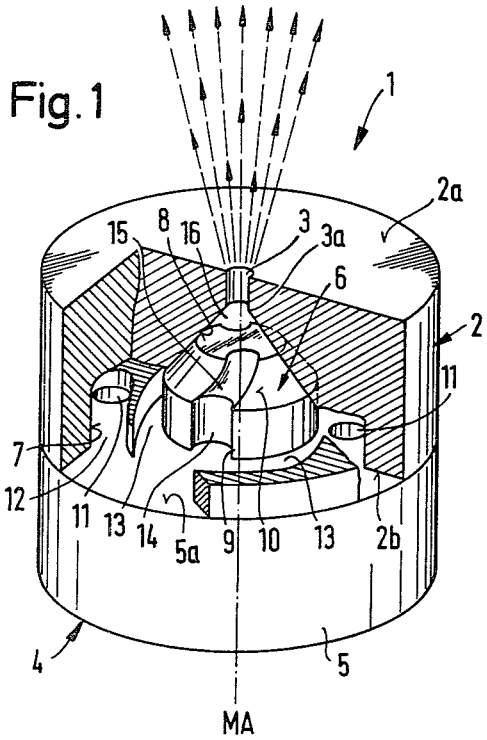
Fig. 2
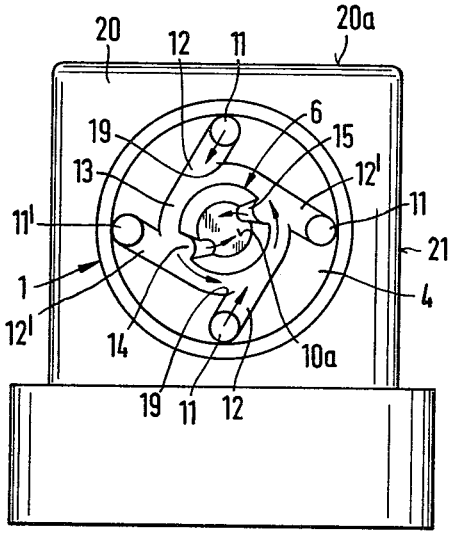
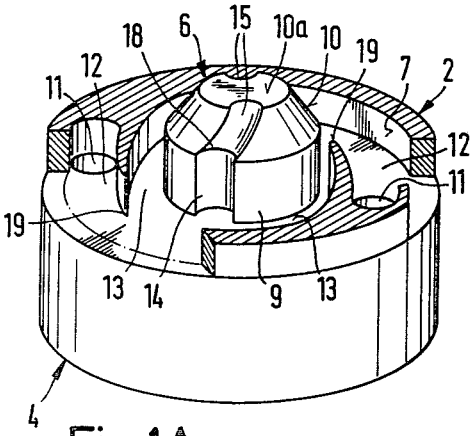
Fig. 1A
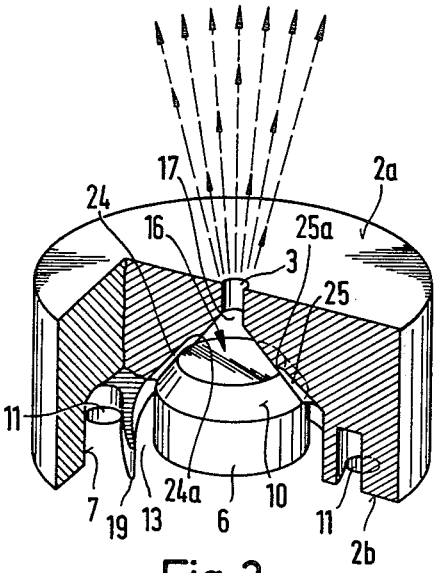
Fig. 3

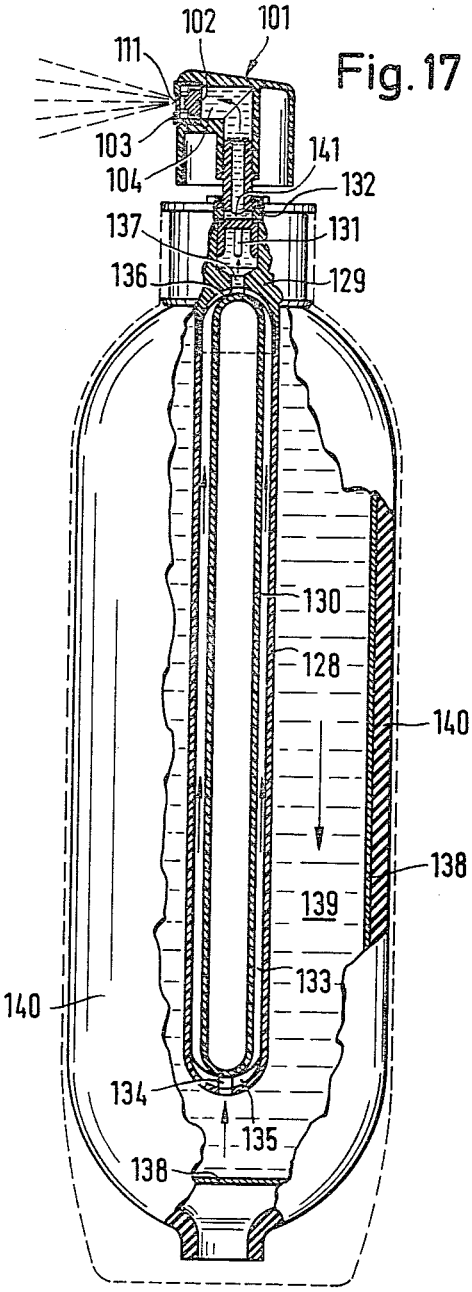
Fig. 17
Fig. 18
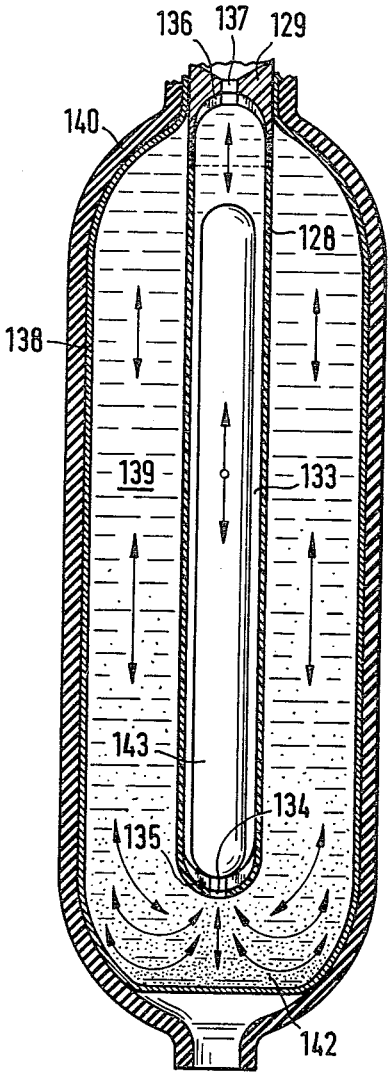

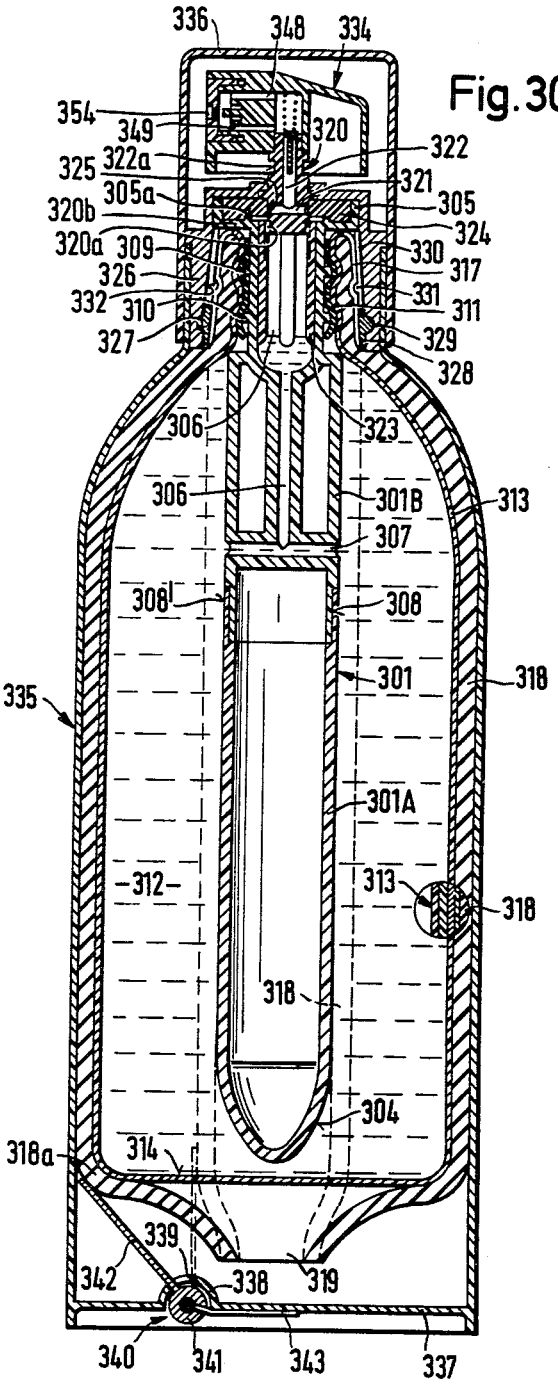
Fig. 30
Fig. 30A
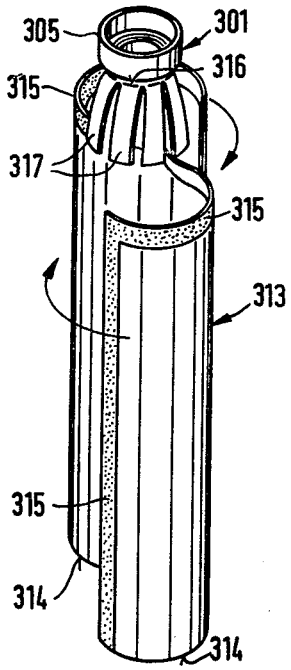

SPRAY NOZZLE, DEVICES CONTAINING THE SAME AND APPARATUS FOR MAKING SUCH DEVICES

BACKGROUND OF THE INVENTION

The invention relates to a spray nozzle for dispensing a liquid, which is subject to an elevated pressure, in the form of a spray comprising (A) a housing having a central nozzle outlet and a central nozzle axis therethrough, and (B) a hollow nozzle interior which is surrounded by a side wall, and through which liquid flows towards the nozzle outlet, and which interior comprises (a) a discharge chamber located upstream of the nozzle outlet on the inside and arranged coaxially with, and along a central plane perpendicular to, the central axis of the nozzle, (b) an annular chamber arranged coaxially to the discharge chamber, (c) at least two feed channels which connect the annular chamber to the discharge chamber, which lead to the latter at least approximately tangentially to the periphery of the discharge chamber and which each run in a plane intersecting the central axis of the nozzle, the feed channels and the annular chamber forming a first stage of turbulence, and (d) at least one supply duct for feeding liquid to the first stage of turbulence from a supply line for the liquid.

Moreover, the invention relates to devices in which the new spray nozzle is used, and to processes for the manufacture thereof.

A spray nozzle of the type initially set forth has been disclosed in U.S. Pat. No. 3,652,018 by John Richard Focht and is used for the mechanical "break-up" of a liquid stream, a spray mist of droplets being formed. This known nozzle is easier to manufacture than a nozzle which is designed to have similar basic features and is described in U.S. Pat. No. 3,083,917 by Robert Abplanalp et al. The feed channels of the known Focht nozzle are separated from one another by separating elements, such as baffles; they start from a common outer annular chamber and end in a common central outlet orifice.

The arrangement of four feed channels which, starting from an outer annular chamber, tangentially open in the wall of a central cylindrical mixing chamber in order to effect an improved atomization of liquid material, has also been disclosed already in U.S. Pat. No. 1,594,641 by Fletcher Coleman Starr in 1926.

U.S. Pat. No. 2,503,481 to William W. Hallinan and No. 3,692,245 to Arthur Michael Needham et al. and British Pat. No. 320,567 to Gustav Schlick also show feed channels which start at the periphery of a frustoconical surface which is tapered toward a nozzle outlet and ends in a flat frontal face opposite the outlet. In the frustoconical surface there are provided grooves forming fluid channels which extend in a curved configuration to the front face and have their outlet openings in the latter face, any obstacle to fluid flow through these channels being carefully avoided or eliminated.

However, these known spray nozzles do not adequately meet the requirements which have to be fulfilled by many products to be sprayed, such as hair lacquer, deodorants, air fresheners or insecticides. Thus, they should have a particle size between 5 and 10$\mu$, for example particularly in the case of hair lacquer, in order to obtain a rapid evaporation period, so that matting of strands of hair is avoided when the consumer pats the set into place after spraying. Air fresheners and insecticides must evaporate rapidly or float in the air so that they do not stain furniture, walls, carpets or parquet floors. In spite of a very fine particle size, the sprayed product must also possess a sufficiently strong impingement force, in the case of hair lacquer, so that the latter not only comes to lie on the hair but can also penetrate in between which ensures an airy set. In the case of air fresheners and insecticides, the spray mist should penetrate as far as possible into the air space to be treated. (The short term "cross section" is used hereinafter for "cross sectional area").

Commercially available spray nozzles such as are available for aerosol cans or pump atomizers, require a pressure of at least 6 atmospheres gauge for producing spray mists of the said quality, when they are used without a liquefied gas component, or they require about 3 atmospheres gauge when such a component is present since, as is known, a propellant consisting of liquefied gas is pressure-relieved in contact with the surrounding air and thus decisively contributes to the formation of the fine droplet size in the spray mist.

OBJECTS AND SUMMARY OF THE INVENTION

Since, however, the spray nozzle according to the invention is preferably to be used for atomization, free from liquefied gas, without an air pump and without other propellants (i.e., in propellantless dispensers), in which case, however, a maximum of 2.4 atmospheres gauge, or sometimes even less pressure, depending on the storage period, is available, it is necessary to design the nozzle in such a way that it is capable, under a relatively low pressure, of providing the required spray quality and, on the other hand, is at the same time simple and cheap to manufacture, whilst it is intended that, if liquefied gas is present in the product and the pressures are correspondingly higher, a hitherto unknown, substantially increased fineness of the particles in the spray mist is to be achieved using this nozzle.

The object described above is achieved and the desired aims are fulfilled in a spray nozzle of the type initially set forth, wherein (1) the hollow interior of the nozzle comprises at least one additional stage of turbulence and (2) on the side wall of the hollow nozzle interior, between a stage of turbulence which is upstream in the direction of flow, and the stage of turbulence, which is immediately downstream thereof, at least one obstacle which serves to break up the liquid flowing from the upstream stage of turbulence to the downstream stage of turbulence and which deflects flowing liquid out of a flow plane, extending through the annular chamber in a direction perpendicular to the central axis of the nozzle, towards the side of the nozzle outlet by an angle of up to 90°. The break-up obstacle can comprise at least one deflection or impingement surface which is opposed to the direction of flow.

Preferably, an additional stage of turbulence is interposed between the supply line and the annular chamber of the first stage of turbulence, the supply line comprising at least two supply ducts running in a substantially axial direction relative to the central axis of the nozzle and the additional stage of turbulence comprising at least two feed channels, the course of which gradually approaches the central axis of the nozzle in the direction of flow, the feed channels being each connected by its inlet orifice to one of the supply ducts and opening through its outlet orifice into the said annular chamber.

The obstacle can comprise a deflection edge, which protrudes into the liquid flowing through the feed channels, in the outer wall region of the side wall which covers the discharge chamber on the side surrounding the nozzle outlet, or in an inner wall region of the side wall of the nozzle interior. The impingement surface can here be formed on a shoulder in the side wall of the nozzle interior, the shoulder preferably being mounted on that region of the side wall of the nozzle interior which is remote from the nozzle outlet. The flow cross-section of the feed channel upstream of the shoulder is preferably larger than that of the same feed channel after the shoulder. The impingement surface can also be provided at the mouth of a feed channel of an upstream stage of turbulence into an annular chamber of the stage of turbulence directly downstream thereof.

In preferred embodiments of the spray nozzle, a peg-like projection protrudes from the bottom surface of the nozzle interior, opposite the nozzle outlet, at least almost up to the inlet side of the nozzle outlet, at least one gap remaining free between the front end of this projection and the inlet rim of the nozzle outlet and constituting the discharge chamber to the nozzle outlet.

The foot zone of the projection is preferably cylindrical and coaxial to the central axis of the nozzle, and the distance of its front end, shaped as an end face, from the side wall containing the inlet side of the nozzle outlet, of the nozzle interior should preferably be at most 0.1 mm. Alternatively, the projection can be tapered towards the nozzle outlet, and in that case the distance of its front end from the inlet rim of the nozzle should preferably be at most 0.05 mm.

In another embodiment of the spray nozzle, the projection, the foot zone of which is surrounded by the annular chamber of the first stage of turbulence, rests by its front end against the inlet of the nozzle outlet and the hollow nozzle interior comprises, between the front end of the projection and that wall region of the hollow interior in the nozzle housing which is in contact with the projection and contains the inlet opening of the nozzle outlet, at least two feed ducts for liquid, each duct extending from the annular chamber to the nozzle outlet in a plane which intersects the central axis of the nozzle outlet. The cross-section of the annular chamber, which remains around the peg-like projection and into which the feed channels of the outermost stage of turbulence lead, here is preferably larger than the cross-section of that annular chamber into which the feed channels of the next-following stage of turbulence lead, and the cross-section of the last-mentioned annular chamber is then larger than that of the innermost annular chamber into which the feed ducts of a further stage of turbulence lead.

In a particularly preferred embodiment of the spray nozzle according to the invention, the additional stage of turbulence comprises (a) an upstream annular chamber which is located at a larger distance from the discharge chamber than the annular chamber of the first stage of turbulence and which extends in the same zone, perpendicular to the central axis of the nozzle, as the first stage annular chamber or in a zone parallel to the latter, and (b) at least two feed ducts leading from the upstream annular chamber inwards to the first stage annular chamber and opening into the latter at least approximately tangentially to the periphery thereof. Four supply ducts can here be arranged symmetrically to the central axis of the nozzle outlet and four feed channels can be provided. The cross-sections of all the feed channels and secondary passages preferably decrease in the direction of flow, at least in their outlet regions. Above all, the cross-section of the feed channels of each stage of turbulence can here continuously decrease from their inlet orifices in the preceding supply duct or annular chamber of the same stage of turbulence up to their outlet orifice located towards the nozzle outlet. The feed channels of the first stage of turbulence can also extend along helices which run conically tapered toward the nozzle axis.

Preferably, the feed channels open into the annular chambers, located at their outlet orifices, tangentially to the periphery of the aforesaid annular chambers. The outer walls of the feed channels and secondary passages can here run tangentially to the peripheral walls of the particular annular chambers into which they open. Preferentially, the cross-section of the outlet of each feed channel and each secondary passage at the outlet point is at most one third of the cross-section of that annular chamber into which it opens.

In the abovementioned, particulary preferred embodiment of the spray nozzle, four to six supply channels, the same number of feed channels of the outer stage of turbulence and the same number of feed channels in subsequent turbulence stages are advantageously provided and the outer walls of the feed channels tangentially merge with the peripheral walls of those annular chambers into which they open, whilst their inner walls run along tangents touching the outer walls of the last-mentioned annular chambers at the respective edge of each of the said inner walls with the outer walls of the last-mentioned annular chambers. In the case of there being three or more concentric annular chambers, the inlet orifice of each feed channel advantageously is in the inner wall of the preceding annular chamber at a short distance before the next upstream feed channel opens into the latter annular chamber, and the inlet orifice of each feed channel of a subsequent turbulence stage is located in the inner wall of the last-mentioned annular chamber at a short distance before the feed channel which is upstream in the sense of flow opens via its outlet orifice or exit into the latter annular chamber, the cross-section of each feed channel of a subsequent turbulence stage preferably decreasing continuously from its inlet orifice up to its exit opening out into the annular chamber next following downstream.

A particularly advantageous effect is also obtained if the flow cross-section of at least one of the annular chambers decreases in each section of that annular chamber which section extends from a point immediately downstream of the exit of a feed channel leading from the outside into an annular chamber up to a point immediately upstream of the exit thereinto of the feed channel which is next in the direction of flow and which leads from the outside into that same annular chamber. The inlet orifices of the feed channels of a downstream stage of turbulence in the inner side wall of the annular chamber located ahead of this stage of turbulence are advantageously offset upstream, with respect to the outlet orifices of the feed channels, leading into this annular chamber, of the preceding stage of turbulence, against the direction of flow of the liquid flowing into this annular chamber through the last-mentioned feed channels, and within the same region as the respective last-mentioned outlet orifice.

It is also possible, in particular in spray nozzles having the features described in the two preceding paragraphs, to provide inlet ducts for a second medium, each of which leads through from the outer wall of the nozzle housing into the outermost annular chamber opens through an outlet orifice between the exits. of two adjacent feed channels opening from upstream into the last mentioned annular chamber through the outer peripheral sidewall of the latter. In particular, the inlet duct opening from the outside between the mouths of two adjacent feed channels, into the annular chamber, can lead tangentially to the direction of flow through the annular chamber, into the latter.

In the embodiment of the spray nozzle described above, in which inlet ducts for a second medium are provided, the flow cross-section of the annular chamber preferably decreases in the sections of each annular chamber from a point immediately downstream of the mouth of the feed channel leading from the outside into the annular chamber upstream of the said inlet duct for a second medium up to a point immediately upstream of the mouth of the feed channel which is next in the direction of flow and which leads from the outside into the annular chamber, as a result of which, when the liquid flows through the feed channels leading in from the outside and through the annular chamber, a second medium is sucked in through the inlet ducts.

In the embodiment of the spray nozzle, described further above, in which a peg-like projection protrudes from the base wall of the nozzle interior, opposite the nozzle outlet, the front end of the projection can be designed as an end face and can form the base area of a conical space; furthermore, the nozzle interior can here be designed as a cavity comprising the annular chamber of the first stage of turbulence as well as the discharge chamber in the surface of the housing, facing inwardly from the nozzle outlet, and the front end of the projection here can form a truncated cone which tapers towards the nozzle outlet and the conical wall of which is in tight contact with a correspondingly shaped inner wall of the cavity, surrounding the inlet side of the nozzle outlet, in which case grooves are then provided in the conical surface of the truncated cone, or in the upper wall of the cavity in contact therewith, or in both, which grooves form the said feed channels of the first stage of turbulence. These grooves can end in the cone wall at a distance from the nozzle outlet and can form, at their end, together with the smooth region of the cone wall extending up to the nozzle outlet a deflective sill which represents a breakup obstacle. These grooves can also represent sections of a helix having a diameter which decreases towards the nozzle outlet.

The invention also relates to a nozzle carrier head having, in the outer wall thereof, inserted as a spray nozzle one of the embodiments described above, and a main conduit for liquid to which the supply ducts are connected, wherein the axis of the main conduit intersects the central nozzle axis passing through the nozzle outlet, the main conduit has a blind end on an inner wall of the nozzle carrier head, at least a first supply duct has its inlet orifice for liquid close to the blind end of the main conduit and at least a second supply duct has its inlet orifice for liquid at a larger distance from the said blind end, and the main conduit, between the inlet orifice of the second supply duct and that of the first supply duct has a shoulder, projecting into the main conduit, from the said inner wall of the nozzle core, the first supply duct extending through the shoulder, thus being longer than the second supply duct. In this nozzle carrier head, the transverse surface of the shoulder which runs transversely to the axis of the main conduit, can form an acute angle with the side wall of the main conduit, in which wall the inlet orifice of the second supply duct is located, and it runs, from the vertex of the angle, facing towards the inlet orifice of the first supply duct up to a common edge with that wall part of the main conduit which contains the inlet orifice of the second supply duct. Moreover, a first zone of the main conduit, which leads from the said edge up to the inlet orifice of the first supply duct and which has the blind end on the inner wall of the nozzle carrier head, can here have a cross-section which, relative to the longitudinal axis of the main conduit, is larger than that of the second zone of the main conduit, which meets the transverse surface of the shoulder, the ratio of the acute angle of inclination of the transverse surface of the shoulder relative to the said longitudinal axis, to the acute angle of inclination of the inner wall of the nozzle carrier head, which represents the blind end of the main conduit, relative to the same longitudinal axis preferably being proportional to the ratio of the cross-section of the first zone to the cross-section of the second zone of the main conduit.

A propellantless spray-can for dispensing a liquid product, having an inner bag consisting of a deformable, nonextensible material to receive the product, an outer covering element which is located around the inner bag and represents an energy store and which consists of an extensible rubber or the like macro-molecular material, a product outlet connected to the bag, a valve installation which is located between the bag and the product outlet and controls the discharge of product from the bag through the product outlet, and a rigid core which is accommodated in the interior of the bag and the cross-sectional area of which is at least 40% greater than the inner cross-sectional area, taken in the same sectional plane, of the covering element in the unextended state and wherein the maximum filling volume of the bag in the completely deployed state without an expansion of the bag wall limits the expansion of the covering element to a maximum value which is within the range of the linear stretching capacity of the said rubber-like macro-molecular material, can possess, built into the product outlet of the bag, a spray nozzle according to the invention in one of the embodiments described above. Furthermore, a fire-fighting jet with a main water supply line can have, as the discharge nozzle, a spray nozzle according to the invention. A fire-fighting jet of this type with a main water supply line and a discharge nozzle can also be equipped with a container for a fire-fighting agent which has a suction line for fire-fighting agent from the container, which suction line opens into the main water supply line shortly before the nozzle.

Another aspect of the invention relates to an internal combustion engine for fuel/air mixture comprising a cylinder of rounded cross-section and a rotary piston of rotational symmetry and rotatable about a central piston axis, which piston is housed in the cylinder with the central piston axis being excentrical with regard to the longitudinal axis through the center of gravity of the cylinder, so that the inner peripheral wall of the cylinder contacts the outer wall of the piston in a zone parallel to the two axes, sealingly, whereby, in operation, several working spaces are located between the outer wall of the piston and the inner wall of the cylinder, which working spaces are alternatingly enlarged and reduced during operation, and comprises at least two explosion chambers in said outer piston wall and open toward said inner cylinder wall and being adapted for receiving an ignitable fuel/air mixture therein and which are uniformly distributed around the periphery of the piston, and the piston further has, adjacent to each of the openings of the explosion chambers and preceding the latter by a short distance in the direction of rotation of the piston, in each case a radial slot which is open in the outer wall of the piston and runs along a radius of the piston; this engine further comprises (a) in each slot at least one slider which is shiftable in said slot transversely to the axis of the piston, each of which sliders has an outer lateral edge parallel to the central axis of the piston which always sealingly engages with the inner wall of the cylinder, and an upper edge always sealingly engaging with the upper end face of the cylinder and a lower edge always sealingly engaging with the lower end face of the cylinder, the slider being urged inwardly in the piston slot housing the same as the zone of the piston containing it makes contact with the inner wall of the cylinder;

(b) an injection device in the inner wall of the cylinder for injecting a fuel/air mixture into a working space downstream of a working zone of maximum compression of the fuel/air mixture contained in an explosion chamber;

(c) an ignition device in the inner wall of the cylinder in the said working zone of maximum compression in which the slider next-preceding the explosion chamber in the latter working zone has partly emerged from its piston slot; whereby, on ignition of the fuel/air mixture compressed therein, a force results which rotates the piston about its longitudinal axis, in the direction of the slider next preceding the explosion chamber of the said work zone;

(d) an exhaust device in a zone of the inner wall of the cylinder, which zone the ignited explosion chamber and its working zone pass on further rotation of the piston after the ignition; and (e) actuating means for actuating the injection device, the ignition device and the exhaust device in sequence, in a work cycle, in coordination with the respective positions of the piston in the cylinder.

The injection device preferably comprises a spray nozzle of the novel type described hereinbefore.

In a preferred embodiment of the internal combustion engine according to this aspect of the invention, the piston comprises a duct extending through a piston portion intermediate two adjacent slider-containing radial slots therein and having an internal opening in the explosion chamber in the piston portion near one of said adjacent slots and an external opening in the side wall of the piston portion remote from the opening of the same explosion chamber in the piston side wall; and a check valve in the said duct adapted for permitting the flow of fuel/air mixture from the external opening through the internal opening of the duct into the explosion chamber, but preventing flow of the mixture through the duct in the opposite direction.

The piston preferably has a circular cross-section, however, it can also be of polygonal, e.g. of hexagonal cross-section.

Two combustion chambers can be provided in the internal combustion engine according to the invention, and the piston can have, adjacent to the orifices of the explosion chambers, a slot which is open on both sides and extends along a diameter of the piston and in which a single solid slider is located which can shift and which, during the rotation of the piston, always sealingly cooperates by its two lateral edges, lying parallel to the axis of the piston, with the cylinder inner wall, by its upper slider edge with the upper cylinder end wall and by its lower slider edge with the lower cylinder end wall.

In order to generate the resultant of the force which rotates the piston, the projection of that side wall of the explosion chamber which is leading in the direction of rotation and adjacent the slider, is preferably larger than the projection of that side wall of the explosion chamber which is farther away from the slider, these projections being on the piston radius passing through the center of the explosion chamber.

The injection device preferably comprises a spray nozzle according to the invention, which is described further above and the nozzle outlet of which opens into the interior of the cylinder.

In a further aspect, the invention relates to a diesel engine comprising a cylinder of rounded cross-section and a rotary piston of rotational symmetry and rotatable about a central piston axis, which piston is housed in the cylinder with the central piston axis being excentrical with regard to the longitudinal axis through the center of gravity of the cylinder, so that the inner peripheral wall of the cylinder contacts the outer wall of the piston in a zone parallel to the said axes, whereby, in operation, several working spaces are located between the outer wall of the piston and the inner wall of the cylinder which working spaces are alternatingly enlarged and reduced during operation, and the outer wall of the piston sealingly cooperates in the manner of a rotary piston pump with the inner wall of the cylinder; the piston comprises at least two explosion chambers in said outer piston wall and open toward said inner cylinder wall, and being adapted for receiving an ignitable fuel/air mixture therein, which chambers are uniformly distributed around the periphery of the piston and have each an orifice in the piston wall; and the piston further has, adjacent to each of the orifices of the explosion chambers and preceding the latter by a short distance in the direction of rotation of the piston, in each case a radial slot which is open in the outer wall of the piston and runs along a radius of the piston; the diesel engine further comprises:

(a) in each slot at least one slider which is located, shiftable, in a slot transversely to the axis of the piston, each of which sliders has an outer lateral edge parallel to the central axis of the piston which always sealingly engages with the inner wall of the cylinder, an upper edge always sealingly engaging with the upper end face of the cylinder, and a lower edge always sealingly engaging with the lower end face of the cylinder, the said slider being urged inwardly in the piston slot housing the same as the zone of the piston containing the respective slot makes contact with the inner wall of the cylinder, but being urged out of the latter slot to remain engaged with the inner wall of the cylinder at all times during the rotation of the piston;

(b) an air compressor, the delivery port of which is connected to the interior of the cylinder via an opening in the inner wall of the latter for impelling compressed air into a working space downstream of a working zone of maximum compression of the fuel/air mixture contained in an explosion chamber;

(c) an injection device in the inner wall of said cylinder for injecting fuel or a fuel/air mixture into the said working zone of maximum compression in which the slider next-peceding the explosion chamber in the latter working zone has partly emerged from its piston slot; whereby, on ignition of the fuel/air mixture compressed therein, a force results which rotates the piston about its longitudinal axis, in the direction of the slider preceding the explosion chamber of said work zone;

(d) an exhaust device in a zone of the inner wall of the cylinder, which zone the ignited explosion chamber and its working zone pass on further rotation of the piston after the ignition; and (e) actuating means for actuating the air compressor, the injection device and the exhaust device in sequence, in a work cycle, in coordination with the respective positions of the piston in the cylinder.

The diesel engine preferably has a piston of circular cross-section; the piston can also be of polygonal, e.g. of hexagonal cross-section.

The injection device can, above all, comprise a spray nozzle according to the invention. Preferably, this is a spray nozzle having inlets for a second medium, these inlets being connected to a water reservoir via a water heater for generating steam. Preferably, the spray nozzle is connected to a pressurized container for liquefied gas of up to 4 atmospheres gauge. An electrical ignition device can also be built into the zone of the inner wall of the cylinder, which contains the injection device.

When assembling the propellantless spray-can which is described further above and has an energy store, it is possible, according to the invention, to use a device which is suitable for assembling a container for dispensing liquid or creamy products, which container comprises an inner bag which has an orifice and consists of a deformable, but non-extensible material to receive the product; an outer elastic element which consists of a macro-molecular material of the rubber type and which surrounds the bag and is open at least at one end; a valve unit which is inserted into the orifices of the bag and the elastic element, for controlling the discharge of product from the bag, and a solid core which is sealingly connected to the bag, the elastic element being firmly held by its orifice around the open end of the bag, which assembing device is characterized in that it comprises extension means for expanding the cross-sectional area of the outer elastic element, which area has, when the elastic element is expanded, a central passage flush with the orifice of the elastic element; and insertion means, with the aid of which the inner part of the container, consisting of the core, the valve unit fixed to one of its ends and the bag surrounding the core, can be inserted into the extension means, and an applicator device, by means of which the expanded elastic element can be brought, with partial contraction of its cross-sectional area, to lie against the outside of the bag surrounding the core, an extended state still being retained.

In this assembling device according to the invention, the extension means can comprise a tensioning tube, the elastic element being slid over one end thereof, whilst the insertion means is flush with the tensioning tube and is aligned for inserting the inner part of the container into the latter until the valve unit strikes the other end of the tensioning tube, and the extension means can, furthermore, comprise conveying means which surround the tensioning tube and with the aid of which the elastic element is applied, beyond the last-mentioned end of the tensioning tube, to the bag arranged around the core, the inner part of the container being simultaneously pushed out of the tensioning tube. The conveying means can consist of a plurality of conveying rollers. In addition, they can comprise a dispenser unit, through which a lubricant is applied to the inner wall of the elastic element or to the outside of the bag or to the said inner wall and to the outside of the bag.

An aerosol spray can, having a pressurized container, a flexible product bag which is accommodated therein and has a discharge valve inserted in an orifice of the latter, and an actuating head carried by this valve and a spray nozzle, according to the invention and of the type described above, which is accommodated in the actuating head and is connected to the valve, can possess, in the pressurized container below the bag, a pressure chamber which is separated from the interior of the pressurized container by a transverse wall and is filled by a pressure-generating medium, and a pressure-equalizing valve can be built into the transverse wall, by means of which pressure-equalizing valve a sufficient amount of medium can flow from the pressure chamber into the interior, surrounding the bag, of the pressurized container, in order to balance the pressure drop resulting in the interior of the pressure container when product is discharged from the bag. The pressure-equalizing valve can comprise a differential piston and a casing having two outlets and seats for the differential piston provided therein, one outlet leading into the interior of the pressurized container and the other outlet leading into the pressure chamber. Preferably, the differential piston is here spring-loaded so that, in the closed, non-dispensing position, it obturates the outlet towards the pressure chamber.

BRIEF DESCRIPTION OF THE DRAWINGS

Further details of the spray nozzle according to the invention and of devices using the latter, and of processes for their manufacture, are explained in the description, which follows, of preferred embodiments thereof in conjunction with the drawings in which FIG. 1 shows a perspective view of a first embodiment of a spray nozzle according to the invention, consisting of an upper half, partially cut away, and a lower inner half of the nozzle housing;

FIG. 1A shows a perspective view of the inner half of the embodiment shown in FIG. 1 and a part of the upper half;

FIG. 2 shows a front view of an aerosol atomizer head, such as can be used for actuating an aerosol spray can or a like atomizer, having a built-in inner half shown in plan view, of the spray nozzle housing according to FIG. 1A;

FIG. 3 shows a perspective partially cut view of a two-part atomizer head with a slightly modified embodiment of the spray nozzle;

FIG. 17 shows a view, partially in longitudinal section, of a propellantless atomizer device using the spray nozzle;

FIG. 18 shows a partial view, in longitudinal section, of a part of the device shown in FIG. 17 with some structural variations;

FIG. 30 is an axial sectional view of a propellantless spray device, described in patent application Ser. No. 061084,506 a continuation of Ser. No. 051843,024;

FIG. 30A shows a perspective view of a product bag which can be used in a spray device according to FIG. 30;

DETAILED DESCRIPTION OF THE EMBODIMENTS

Figure 4:
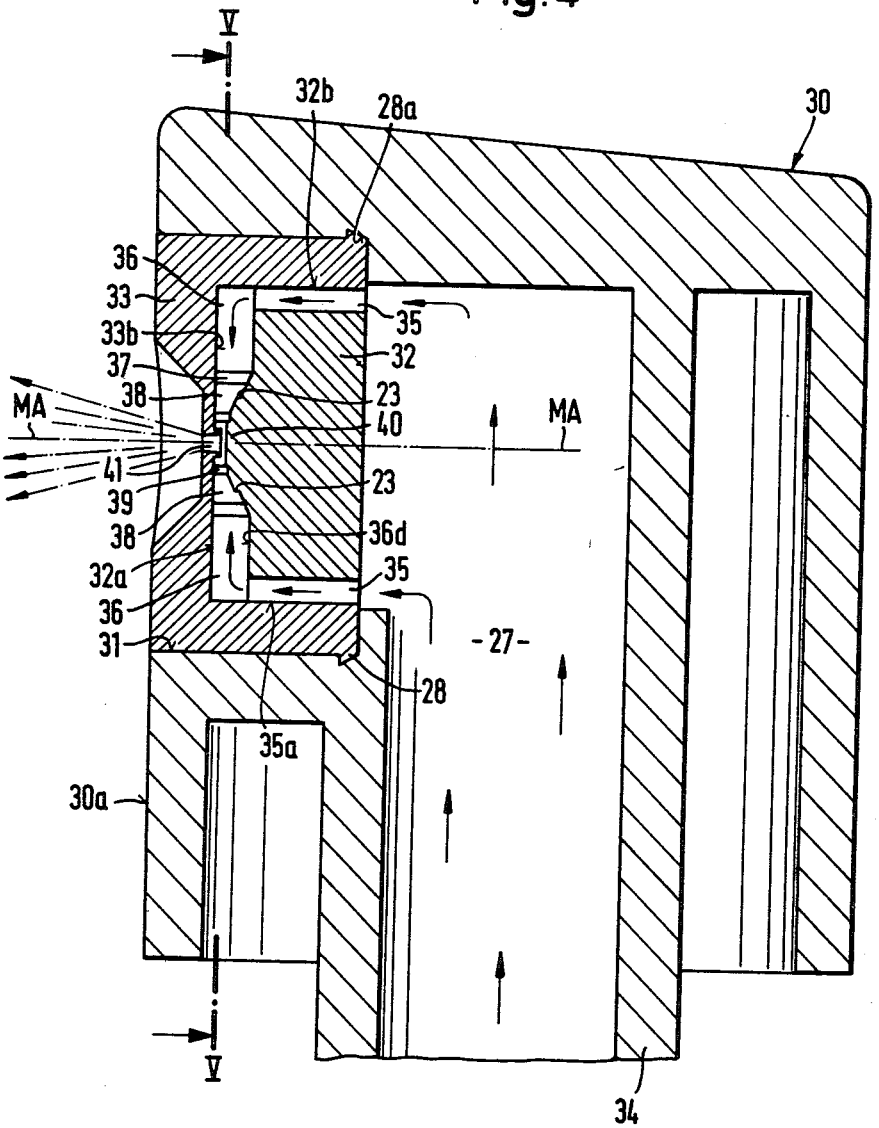
FIG. 4 is a longitudinal sectional view of an atomizer head with another two-part embodiment of the spray nozzle according to the invention.

The embodiment of the spray nozzle, shown in FIGS. 1 and 1A, comprises a nozzle body 1 which consists of the upper case part or outer half 2 of the nozzle, which has the outer orifice of a nozzle outlet 3 in the center of its upper outer end face 2*a*, and of the lower or inner half 4 of the nozzle body 1, which carries a nozzle core 6 on the frontal face 5*a* of its base part 5, facing the nozzle outlet 3.

The case part 2 has, on its lower end face 2*b* facing the inner half 4, a cylindrical cavity 7 which continues upwards into a recess 8 of frustoconical configuration, the nozzle outlet 3 opening outwards at the apex of the cone.

The nozzle core 6 possesses a cylindrical foot part 9 of a diameter smaller than the internal diameter of the cavity 7, and, above the foot part, a conically tapered rim surface 10 which makes sealing contact with the conical end wall of the recess 8, when the two nozzle pieces 2 and 4 are assembled.

In the base part 5 of the inner body 4, two supply ducts 11 are provided which run parallel to the central axis MA of the nozzle, extending through the nozzle outlet 3, and which are arranged symmetrically thereto in the axial direction and which are adjoined by feed channels 12, through which the pressurized liquid, which is to be sprayed, is supplied to the annular chamber 13, of a first stage of turbulence of the nozzle, remaining between the frontal face 5a, the foot part 9 and the upper end wall and a nose part of the outer peripheral wall of the cavity 7, which nose part in each case protrudes inwards up to an axial edge 19.

In the cylindrical foot part 9, two grooves 14, extending axially with respect to the central axis MA of the nozzle, are provided as sections of secondary feed passages which latter continue in the conical rim surface 10 as grooves or passages 15, which are shaped as sections of a helix narrowing in each case in the direction of flow and which extend up to the turbulence chamber or vortex chamber 16 which is delimited by the upper end face 10a of the nozzle core 6 and the inner wall of the recess 8, thus being in the shape of a truncated cone. The cross-sectional area of the passages 15 gradually decreases towards their outlet orifices, that is to say their mouths in the vortex chamber 16.

The supply ducts 11, annular chamber 13, feed channels 12, passages 14,15 and vortex chamber 16 as well as the discharge chamber 17 which is downstream thereof in the direction of flow and which is upstream of the nozzle outlet 3 in the direction of flow, form the hollow nozzle interior of the embodiment according to FIGS. 1 to 3.

At the shoulder point between each passage section 14 and the passage 15 adjacent thereto, there is an obstacle to generate or increase mechanical break-up of the liquid product flowing through. In the embodiment according to FIGS. 1 and 1A, this obstacle comprises a step 18 on which a change in direction of the stream of liquid occurs, and two zones of the side wall of the downstream passage 15, both that lying next to the end face 2a and that inclined into the liquid flowing through the passage section 14, act as deflection surfaces or impingement surfaces.

The two nozzle halves 2 and 4 can be manufactured in a simple manner by known injection-molding processes and can thermally be welded or bonded to one another. Of course, can-type connections can also be provided at the peripheral joint of the two halves.

In the spray head 20, shown in FIG. 2, the nozzle body 1 is inserted in the customary manner in the lateral head wall 21. Of course, it can also be inserted into the frontal face 20a of the atomizer head.

Since the outer half of the nozzle is removed in FIG. 2, only the inner half 4 of the nozzle body, corresponding to that shown in FIG. 1A, is visible in plan view.

In FIG. 2, the arrangement of two primary feed channels 12 which lead tangentially in the direction of flow into the annular chamber 13, the inside of their wall forming, with the outer wall of the annular chamber 13, the wall edge 19, is is the minimum of feed channels required, whilst two further feed channels 12' which are connected to two further supply ducts 11', is the preferred one. Axial passage sections 14 and the passages 15 then lead from the annular chamber 13 to the vortex chamber 16, located above the end face 10a of the nozzle core 6, and further to the nozzle outlet 3.

A further embodiment of the spray nozzle is shown in FIG. 3. In this embodiment, the passage sections 14 and passages 15 are omitted and are replaced by grooves 24 and 25 which are provided in the conical inner wall of the recess 8, are guided in planes extending radially to the central axis of the nozzle or preferably extend in the manner of a helix with a diameter decreasing towards the nozzle outlet 3 and form feed channels. The upper end walls 24a and 25a which are inclined rather steeply into the flowing stream of the liquid and which are located towards the nozzle outlet 3, represent obstacles in the flow path, which assist the mechanical break-up of the liquid.

Thus, the recess 8, which is of fructoconical shape, encloses both a turbulence chamber 16, extending approximately to the zone of the upper ends of the grooves 24 and 25, and a discharge chamber 17 above the former.

The dispenser actuating head 30, shown in FIG. 4 in longitudinal section, contains in its side wall 30a a recess 31 into which the spray nozzle is inserted, which is shown in a further embodiment and which consists of a nozzle case 33 and a nozzle core 32 fitted into the recess 33a provided in the inner end wall of the nozzle case 33. The nozzle core 32 carries depressions formed in its front end face 32a, which is in sealing contact with the bottom 33b of the recess 33a and faces the nozzle outlet 41, and in its lateral peripheral wall 32b which is in close contact with the side wall 33c of the recess 33a, which depressions form the hollow nozzle interior consisting of chambers and channels, when the nozzle is produced by assembling the nozzle core 32 and the nozzle case (nozzle shell or mantle) 33.

Figure 5:
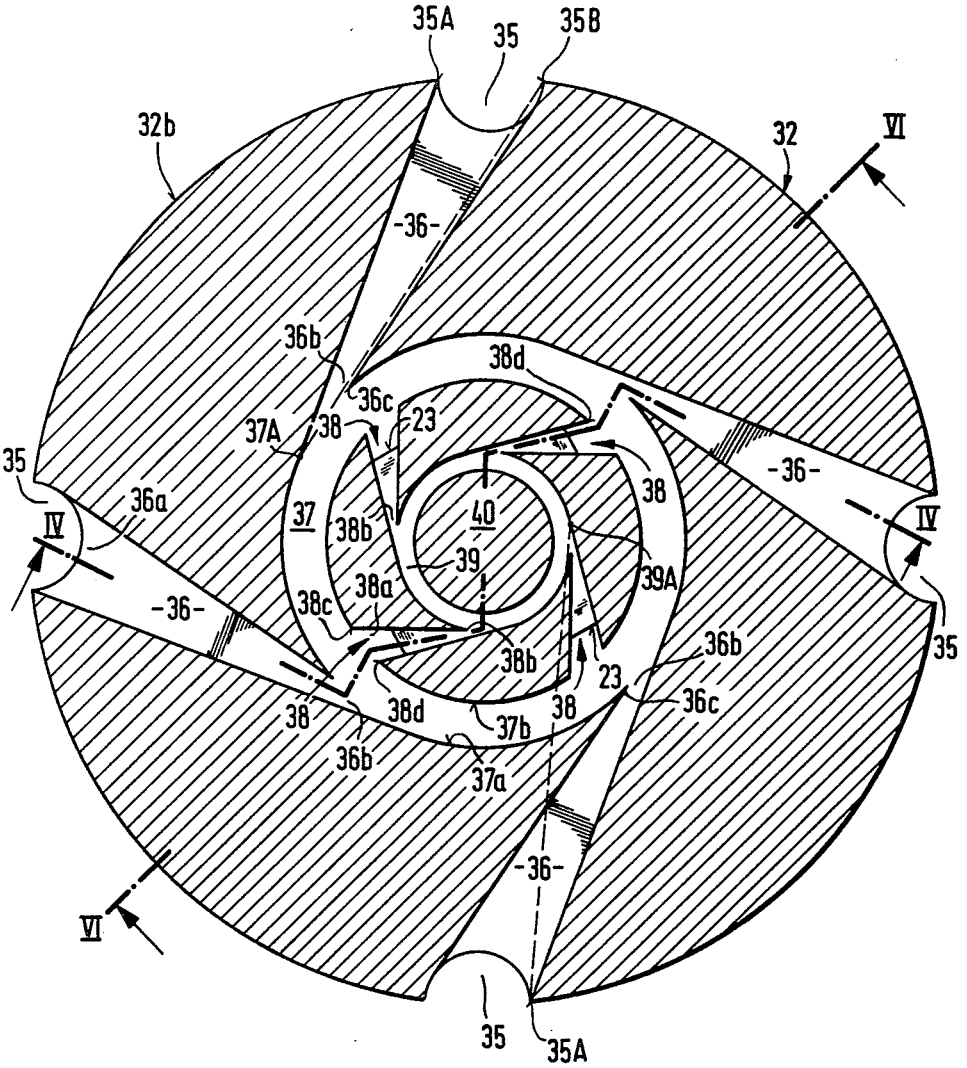
FIG. 5 is a cross-sectional view of the nozzle insert of the preceding embodiment, along a plane indicated in FIG. 4 by V—V, (the plane of FIG. 4 is indicated in FIG. 5 by (IV—IV) and on an enlarged scale.
Figure 6:
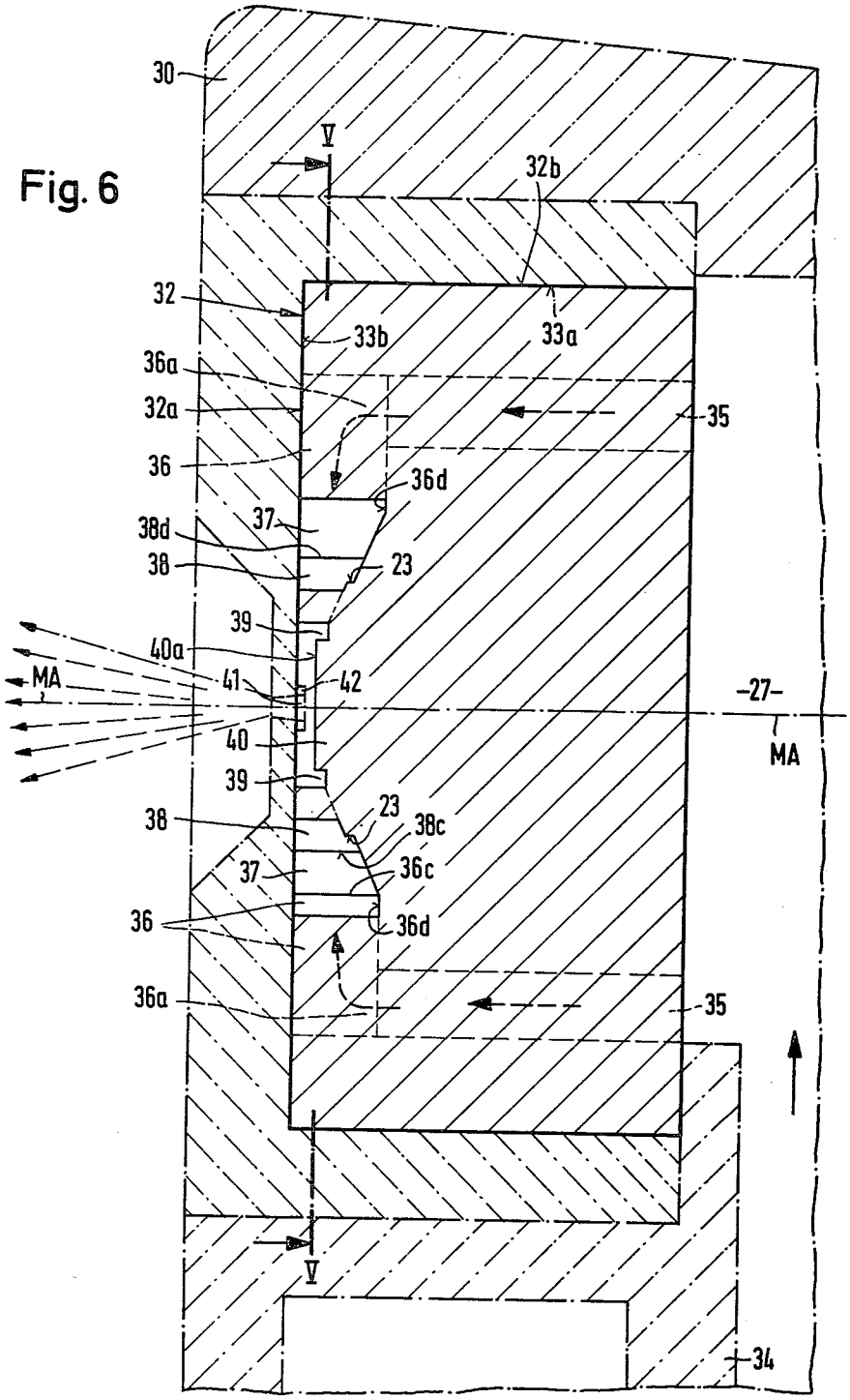
FIG. 6 is an axial sectional view of the nozzle insert core of the embodiment, shown in FIG. 5, along a plane indicated in FIG. 5 by VI—VI.

The said depressions are specially illustrated in the representations of the nozzle core 32 according to FIGS. 5 and 6.

The actuating head 30 carries on its underside a sleeve piece or neck part 34, which is open downwards and into which the valve shaft of an aerosol spray can can be inserted in a known manner. The interior of the sleeve piece 34 forms the main supply line or conduit 27, from the upper end zone of which in the actuating head 30 four supply ducts 35, which are formed by longitudinal grooves in the peripheral wall 32b of the nozzle core 32 lead in the axial direction with respect to the central axis MA of the nozzle to depressions in the end face 32a, which form the turbulence system of the nozzle. The latter comprises, as can be seen from FIG. 5, four outermost feed channels 36 which are each connected by their inlet orifice 36a to the front end of one of the axial supply ducts 35 and which each run skew to the central axis of the nozzle in a plane, intersecting this axis at a right angle, and open tangentially into a common first annular chamber 37, their exits (or outlet orifices) 36b being symmetrically distributed around the outer peripheral wall 37a of the annular chamber 37 (FIG. 6) and forming, with the latter peripheral wall, the guiding edge 36c.

From the annular chamber 37, four feed channels 38 of the next stage of turbulence lead inwards into the nozzle into a second inner annular chamber 39 which surrounds a pge-like projection 40 which protrudes from the plane determined by the bottom surfaces 36d of the feed channels 36 up to almost the entry into the nozzle outlet 41.

As can be seen, the annular chambers and channels are covered hermetically, or at least liquid-tightly, by the bottom surface 33b of the recess 33a. A pressurized liquid flowing through the hollow nozzle interior can thus only move through the channels and annular chambers toward the nozzle outlet 41.

The most ideal conicity of the feed channels 36 is achieved if a tangent is drawn from the channel side 35A to the periphery of the annular chamber 37 and a straight line is drawn from the channel side 35B through the point of intersection 37A of this tangent with the annular chamber 37. Advantageously, the width of the annular chamber 37 is then selected in such a way that it is equal to the width of the exits 36*b* of feed channels 36 in the annular chamber 37. This configuration enables the liquid under pressure arriving from the supply ducts 35 to be accelerated by the narrowing of feed channels 36 to the exits of the latter in annular chamber 37, and to impart a component of centrifugal force to the liquid by the rotational movement to which the liquid is subject in annular chamber 37. Furthermore a suction effect is produced in the annular chamber 37 at eachh exit 36*b* of a feed channel 36. The optimal location for edge 38*d* of the inlet orifices 38*a* of the feed channels 38 of the second turbulence stage is obtained by drawing from the first contact point of edge 36*c* between the straight line 35B–37A with the annular chamber wall 37*a* a tangent to the periphery of the second annular chamber 39, and the optimal width of the inlet orifices 38*a* of passages 38 is obtained by drawing a straight line from the point 39A where the last-mentioned tangent touches the second annular chamber 39 to a point 35A of the lateral edge 35*a* of supply duct 35. Advantageously, the width of the annular chamber 39 is so chosen that it is identical with the sum of the mouths of the passages 38 in that annular chamber, whereby the diameter of the peg-like projection 40 is also determined. The height of feed channels 36 in axial direction remains unchanged, which on the contrary the feed channels 38 become narrower beginning from their inlet orifices 38*a* between the two axial wall edges 38*c* and 38*d* with regard to their width in the plane of FIG. 5 and also with regard to their height (in axial direction) up to their exits 38*b* in annular chamber 39.

Figure 7:
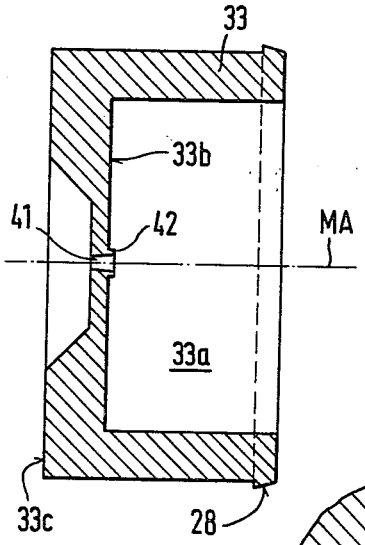
FIG. 7 is an axial sectional view of a nozzle case of the spray nozzle which fits on to the insert cores of FIGS. 5 and 6.

This narrowing is preferably not continuous, but is interrupted by a step 23 constituting an obstacle generating mechanical break-up and turbulence already during acceleration of the liquid in the second stage feed channels 38 (FIGS. 5 and 6). The peripheral edge about the frontal face 40*a* of projection 40 also leads to turbulence in the liquid flowing through the second stage feed channels 38. An additional turblence is caused by an annular bead 42 located on the inside of the nozzle case 33 around the nozzle outlet 41 (FIG. 7).

In the spray nozzle according to the invention, a pressurized liquid is accelerated, set in rotation and swirled in a controlled manner, which leads to an optimum utilization of the available ejection force. The volume of the main conduit 27 is substantially larger as compared with the channels and passages which have been mentioned and are connected thereto. This volume of the main supply conduit 27, oversized as compared with the subsequent supply ducts and feed channels is on the one hand necessary so that the available pressure force, to which the liquid is subject, is brought into action up to the supply ducts 35 without restriction, and on the other hand, so that the feed channels remain free even in the case of a liquid which dries easily, as a result of slowed-down evaporation of a relatively large quantity of liquid stored in the main supply conduit 27.

The spray output of the spray nozzle according to the invention can be adapted to the particular viscosity of the liquid by correspondingly altering the cross-section of the supply ducts 35 and also the cross-sections of the spaces 36, 37, 38 and 39 of the hollow interior. A higher viscosity of the liquid demands of course a larger cross-section than a low viscosity.

The size of droplets in the spray can be adjusted by altering the distance between the peg-like projection 40 and the annular rib 42 of the nozzle case 33; the smaller the distance, the smaller is the size of the drops.

Of course, the distance must not be kept too small, which reduces the ejection velocity and also enlarges the ejection angle of the spray mist, unless these effects were desired for a certain product. The ejection angle of the spray mist also depends on the length of the nozzle outlet 41 of the nozzle case 33. The longer the outlet 41, the smaller is this angle.

Figure 8:
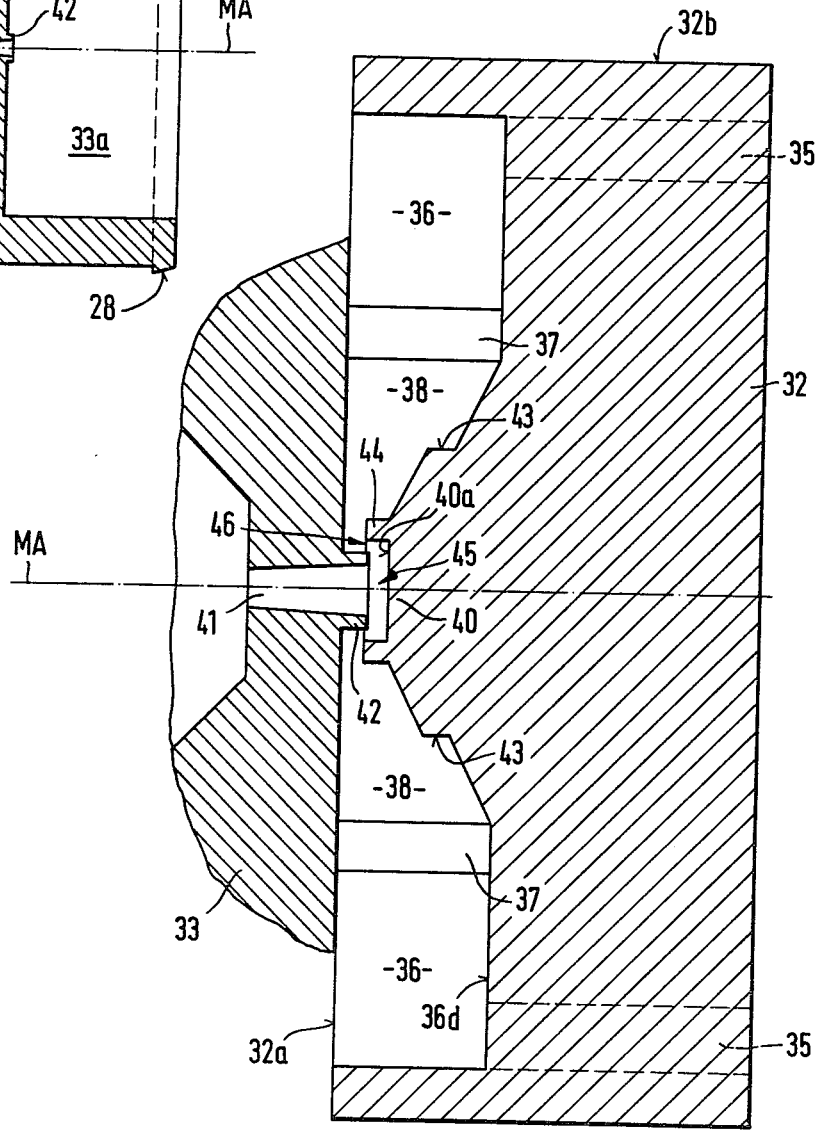
FIG. 8 is an axial sectional view of a central region of the nozzle assembled from the components according to FIGS. 6 and 7, on an enlarged scale.

FIGS. 7 and 8 show a further advantageous embodiment of the spray nozzle according to the invention. The nozzle core 32 resembles that shown in FIGS. 4 to 6, except that, instead of the second annular chamber 39, it has a turbulence chamber 45 which is formed as the result of the projection 40 carrying an axially protruding annular flange 44 around its front face 40*a*. The depression formed inside the flange on the front face 40*a* is the upper inner limit of the turbulence chamber 45, whilst the bottom surface 33*b* of the recess 33*a* in the nozzle case 33 delimits this chamber on the outside, the annular bead 42, the outer diameter of which is somewhat smaller than the inner diameter of the annular flange 44, protruding slightly into the turbulence chamber 45. Thus, an annular gap 46 remains between the annular flange 44 and the annular bead 42, which gap effects a considerable increase of turbulence in the turbulence chamber 45, particularly if the upper rim of the annular bead 42 protrudes up to the plane of the upper rim of the annular flange 44 or beyond this plane into the interior of the turbulence chamber 45 (FIG. 8).

In the embodiment according to FIG. 7, the nozzle case 33 is provided on its inner rim surrounding the recess 33*a*, with an annular flange or crimp 28 which engages so firmly with a corresponding recess 28*a* of the actuating head 30 that it cannot be expelled from the actuating head 30 even by a liquid which is under a strong pressure.

Figure 9:
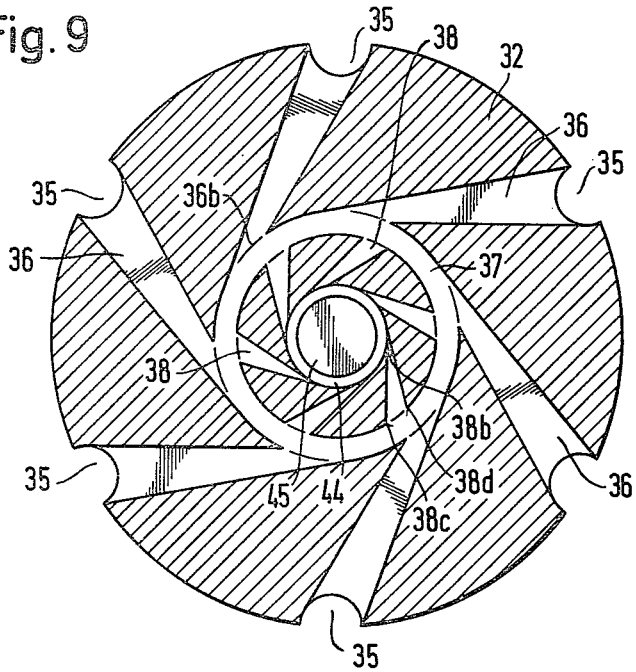
FIG. 9 is a cross-sectional view of an embodiment similar to that shown in FIGS. 5 to 8, but having six feed channels.

FIG. 9 shows a further embodiment of the nozzle core 32 having six supply channels 35 which lead to six feed channels 36 and end in a common annular chamber 37 from where six second stage feed channels 38 lead to the common second annular chamber 39 which is delimited by the peg-like projection 40.

Figure 10:
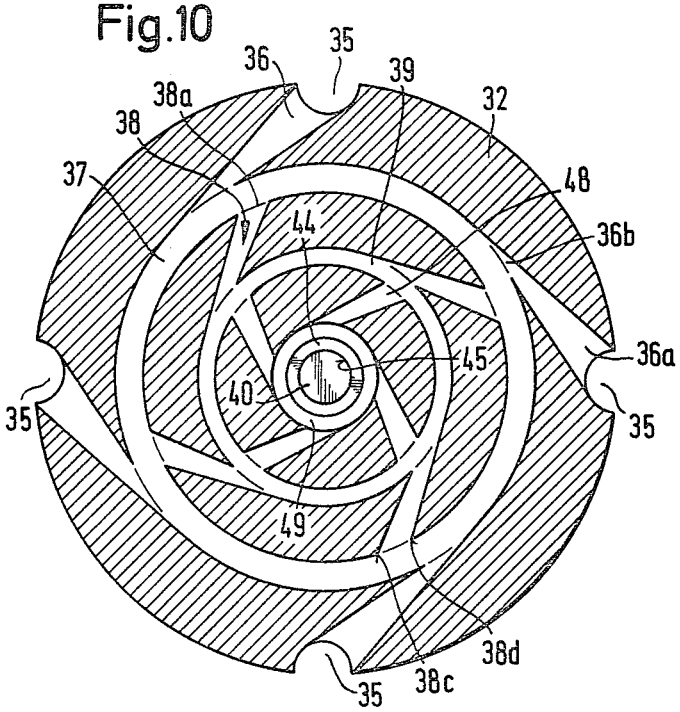
FIG. 10 is a cross-sectional view of a further embodiment of the nozzle insert core, having three stages of turbulence.
Figure 11:
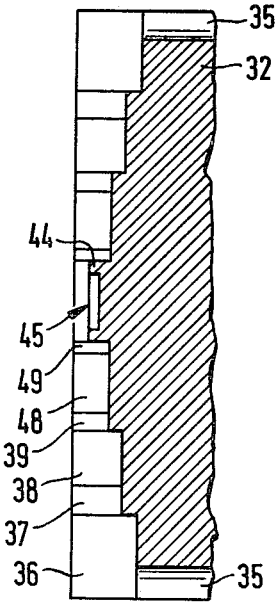
FIG. 11 is an axial sectional view of the nozzle insert core shown in FIG. 10.

FIG. 10 shows a further embodiment in which the spray nozzle according to the invention can be provided not only with two, but also with three or more successive stages of turbulence, that is to say, additionally to the channels and annular chambers 36, 37, 38 and 39, the nozzle core 6 can also contain a number of tertiary feed channels 48 and the annular chamber 49 and can be provided with a turbulence chamber 45 above the projection 40. Of course, the number of successive turbulence stages also depends on the available pressure of the liquid so that the liquid flow is not unduly braked by excessive friction. The higher the pressure to which the liquid is subject, the more turbulence stages can be provided. In this embodiment according to FIG. 10, the height of the feed channels does not decrease conically but stepwise towards the turbulence chamber 45; in this case, each step forms an obstacle resulting in vortices and the achieved narrowing of the feed channels is a factor accelerating the liquid stream (FIG. 11).

Figure 12:
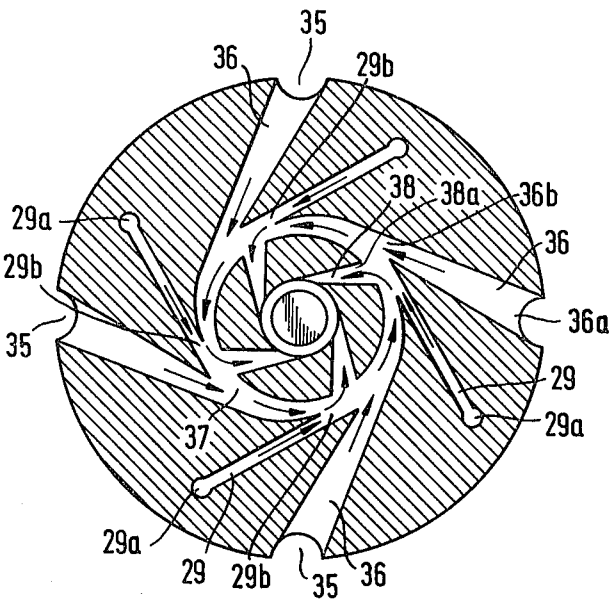
FIG. 12 is a cross-sectional view of a nozzle insert core similar to that shown in FIG. 5, but having additional inlet ducts for introducing a second medium.

FIG. 12 shows yet a further embodiment of the nozzle core 32, in which the latter, additionally to the channels 36 and 38, also has inlet ducts 29, the entry orifices 29*a* of which are not offset on the periphery of the nozzle core 32 but towards the center thereof and which are supplied via passages 26 extending axially from the front face 33*c* of the nozzle case 33 through the nozzle core. The inlet ducts 29 are arranged in such a way that they open out into the annular chamber 37 tangentially to the outer side wall thereof at points, which generate suction, between the exits 30*b* of every two adjacent feed channels 36.

In order to generate an additional suction effect in the inlet ducts 29, the outer wall of the annular chamber 37 is not absolutely circular but tapers in each case just before (as viewed in the direction of flow) the exits 29*b* of the inlet ducts 29. The liquid, which flows in from a feed channel 36 and has already been accelerated, is then driven into the subsequent narrowing region of the annular chamber 37 where it is accelerated once again so that it effects suction when it flows past the exit 29*b* of an inlet duct 29, and this effect is enhanced since this exit 29*b* is located slightly behind (that is to say upstream of) the inlet opening 38*a* of a feed channel 38, through which the liquid flows to the nozzle outlet 41. The inlet ducts 29 are provided in order to suck in a second medium, such as, for example, air, and to mix it with the liquid flowing through the nozzle interior.

Since the spray nozzle according to the invention is intended to be preferably used for dispensing a product which is free from gas and in particular also from a propellant gas, it is necessary, if a foam-forming product, for example shaving cream, is to be dispensed as a foam and if this, requires the presence of a gaseous medium to form the foam, also to introduce a gas phase in addition to the base liquid of the shaving cream. This can be effected if the base liquid, while flowing through the feed channels 36, the annular chamber 37 and the feed channels 38, can suck in air through the orifices 29*a* of the inlet ducts 29, which air then forms the shaving foam, when mixed with the liquid (FIGS. 12 to 15).

Figure 15:
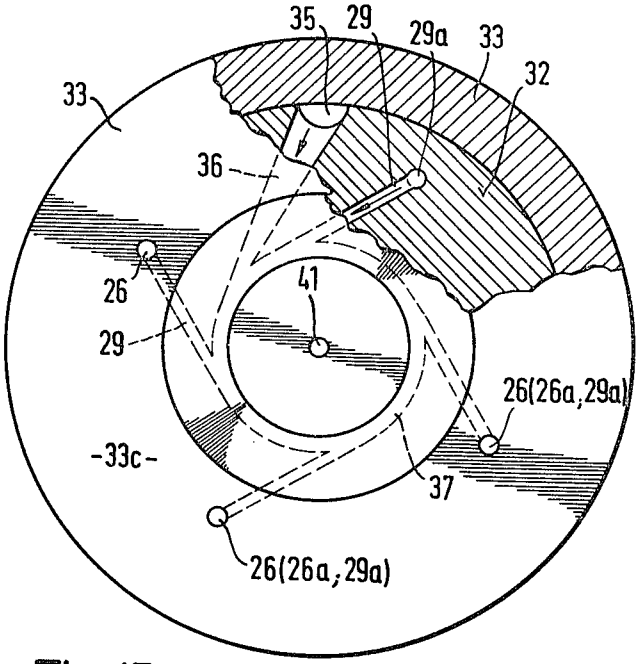
FIG. 15 shows a view similar to that of FIG. 14, but having several suction orifices for a second medium without a control valve, the sectional view of a portion of FIG. 15 being taken in a plane indicated by XV in FIG. 13.
Figure 14:
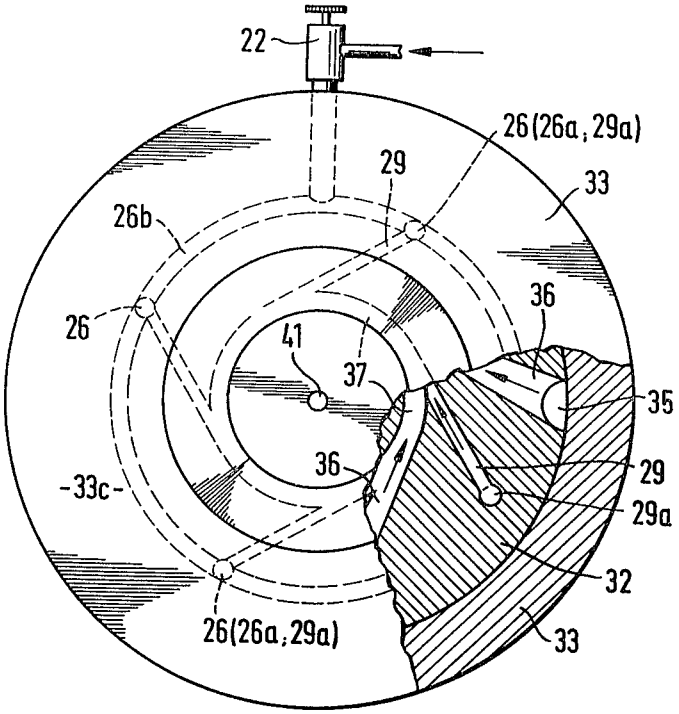
FIG. 14 is a frontal view, partially in section along a plane indicated by XIV in FIG. 13, of an embodiment of the spray nozzle having a nozzle outlet, an annular intake channel and a control valve as shown in FIG. 13.

Since, in a gas-free alternative for aerosol cans described further below, oil can also be filled in additionally to foam-forming emulsions which, however, likewise require a gas medium in order to emerge as a dust cloud or spray mist from a spray nozzle, it is possible to suck in this gas medium (air) via the inlet ducts 29 by means of the spray nozzle according to the invention. The cross-section of the inlet ducts 29 depends on the desired quantity of air, which is required for mixing, and this must thus be adapted from case to case. FIGS. 14 and 15 show a spray nozzle which has a nozzle case 33 and a nozzle core 32 inserted therein and in which the four orifices 29*a*, through which a second medium can be sucked in via the inlet ducts 29, are connected to one another via passages 26*a* and an annular channel 26*b* (shown in dashes in FIG. 14) which runs in the nozzle case 33 and is connected to an inlet valve 22 by means of which the quantity of the second medium sucked in can be controlled. In addition to a gas medium, such a design can also suck in other fluid media, such as liquids or fine powders, and this is described in more detail in the following text.

Figure 16:
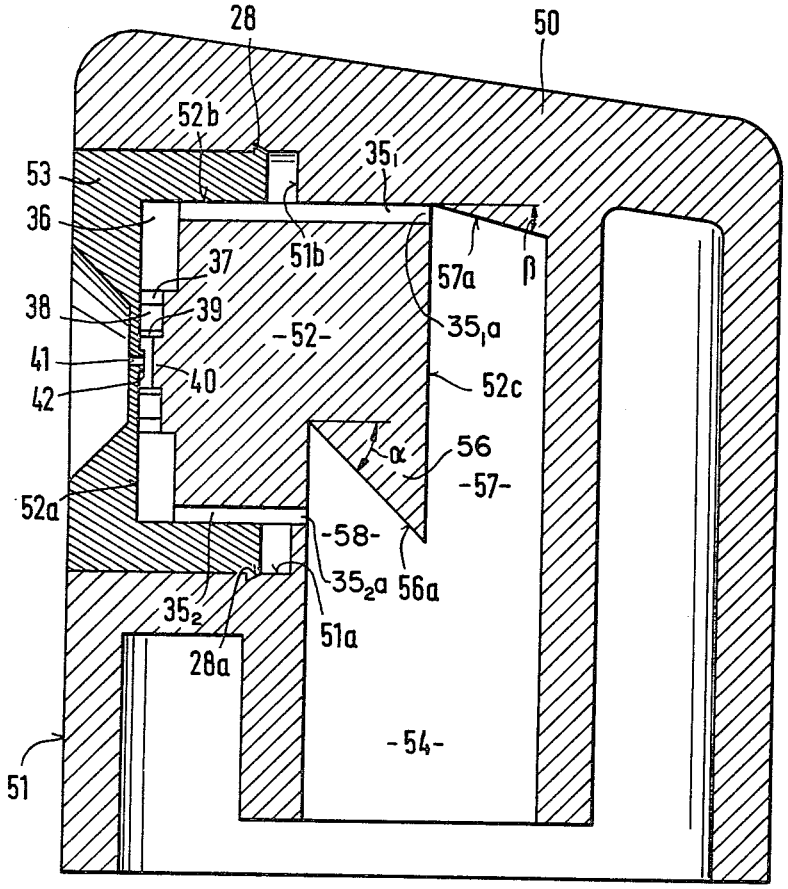
FIG. 16 is an axial sectional view of another preferred embodiment of an atomizer head containing a spray nozzle according to the invention.

FIG. 16 shows a longitudinal section through an actuating head with another advantageous embodiment of the spray nozzle according to the invention. In this case, the various channels, passages and annular chambers are molded on, or eroded in, an inner nozzle body 52 on the front face 52*a* and peripheral wall 52*b* thereof and are covered by a nozzle case according to FIG. 7. The nozzle body is preferably molded integrally with the actuating head 50 and protrudes from the bottom 51*b* of the recess 51*a* in the side wall 51 for such a distance that sufficient clearance remains above and around it for a firm, tight insertion of the nozzle case 53 into the side wall 51 of the actuating head 50. Such an embodiment is only possible if the diameter of the nozzle body 52 permits the provision of the four supply ducts 35 by injection-molding techniques, that is to say if the diameter is too large, the supply ducts 35 become too long. Since these must have a very small cross-section, namely between 0.3 and 0.6 mm depending on the viscosity of the product, they must be kept as short as possible. Experience shows that the most advantageous upper limit of the total diameter of the nozzle body 52 is about 16 mm in this embodiment. If the diameter must be larger for any reasons, it is advisable to choose the embodiment according to FIG. 4. The main supply conduit 54 has a shortened conduit part 58 on the inner end wall 52*c* of the nozzle body 52 and a remaining narrowed conduit part 57 leading further into the actuating head 50. Moreover, the angle $\beta$, formed by the blind end 57*a* of the narrowed conduit part 57 with the central axis of the nozzle, is flatter than the corresponding angle $\alpha$, formed by the blind end 56*a* of the shortened conduit part 58. These angled-off blind ends 56*a* and 57*a* serve as baffle surfaces or damming-up surfaces for liquid which flows in the main supply conduit 54 and which is impelled by means of these baffle surfaces under a more or less high pressure into the supply ducts $35_1$ and $35_2$. If the main supply conduit 54 were of cylindrical shape, a back-pressure would be formed at the blind end 57*a* thereof, which back-pressure would impel the liquid under a higher pressure via the upper supply ducts 35, having entry orifices $35_1a$ than via the lower supply ducts $35_2$ having entry orifices $35_2a$. According to the invention, this is avoided by a transverse impingement surface 56*a* on a shoulder 56 which protrudes from the inner wall 52*c* of the nozzle core 52 into the main supply conduit 54, above the lower ducts $35_2$ and the surface and angle of inclination of the impingement surface are selected so that the back-pressure generated there in the ducts $35_2$ lying below is identical to that in the upper ducts 35. If the four supply ducts $35_1$ and $35_2$ have a non-uniform delivery of pressure, the spray mist becomes unsymmetrical.

The following figures illustrate various possible applications of the new spray nozzle in devices of known and novel types. FIGS. 17 to 21 show a new propellant-free injecting or spraying apparatus and its assembly (as also described in my patent application Ser. No. 06/084,506, supra).

This apparatus is a propellant gas-free alternative to the known aerosol spray cans. The spraying apparatus shown in FIG. 17 carries a spray nozzle according to the invention and is filled with a liquid which is to be dispensed. The valve unit required in this device comprises an outer hollow core 128 which is mounted on the piston seat 129, the piston 131, the ring gasket 132 consisting of elastic material and the inner hollow core 130 which is located in the outer hollow core 128. The interspace 133 between the outer hollow core 128 and the inner hollow core 130 here serves as a liquid duct to the piston 131. At its rounded-off end, the outer hollow core 128 is provided with the orifice 134 and, in the interior, it has several ribs 135 around the orifice 134. At that end which carries the outer hollow core 128, the piston seat 129 is provided with the bore 137 and likewise has several ribs 136 around the orifice of bore 137. The length of the inner hollow core 130 is kept such that its ends firmly rest on the carrier ribs 135 and 136. The container 138 which contains the liquid 139 is fastened to the piston seat 129 so that the outer and the inner hollow core 128 and 130 are in the longitudinal axis of the container 138. The latter is surrounded by a rubber hose 140 which serves as an energy store. The properties and physical characteristics of the container 138 and of the rubber hose 140 and of the outer hollow core 128 have already been described in my abovementioned patent application Ser. No. 06/084,506 Supra, but they are mentioned here because the valve device, which also includes the spray nozzle according to the invention, represents a preferred, particularly advantageous embodiment. The arrangement of an inner hollow core 130 in the outer hollow core 128 is advantageous since it requires the least assembly work and additionally makes it possible to vary the cross-section of the liquid duct 133 without high costs, if a certain product should make this necessary. Moreover, compared with the earlier valve piston, the pasages 141 of the piston 131 should be substantially larger in order to pass the liquid 139 effectively, without braking, via the main channel 104 of the actuating head 101 in the channels, annular chambers and passages of the nozzle core 102, which have been described, under the full excess pressure to which it is subjected by means of the rubber hose 140. According to the invention, the liquid 139 thus flows through the orifice 134 and flows through to the interspace 133 between the ribs 135 and flows from there between the ribs 136 through the orifice 137 up to the ring gasket 132. When the actuating head 101 is pressed down, the passages 141 of the piston 131 are exposed so that the pressurized liquid 139 can flow through the main channel 104 and the channels, annular chambers and passages of the nozzle body 102, which have been described, so that the liquid 139 finally emerges as a fine spray mist from the spray nozzle according to the invention via the nozzle outlet 111, and specifically for as long as the actuating head 101 is pressed down, which functionally corresponds to the spray of an aerosol spray can using a propellant, but without gas in this case.

FIG. 18 shows that, using the valve device according to FIG. 17, yet a further problem can be solved. There are many liquids which, filled into aerosol spray cans, already deposit a sediment after a short storage time and thus must be shaken before use in order to re-mix the sedimented material with the liquid phase of the product. For this purpose, small steel balls which ensure the mixing process on shaking, are used in the aerosol spray cans. Experiments of this kind were also carried out with the present gas-free alternative, but they showed that, depending on the intensity of the shaking motion, in particular if a part of the liquid had already been ejected, the rubber hose 140 firmly lodges around the outer hollow core 128, starting from the piston seat, and thus exerts a strong contact pressure on the container 138, as a result of which the steel balls are jammed between the outer hollow core 128 and the container 138 or the rubber hose 140 and remain there, that is to say they are no longer available for mixing.

In FIG. 18, a sediment 142 which has settled out of the liquid 139, is indicated at the base of the container 138. Whilst the outer hollow core 128 is identical to that of FIG. 17, the inner hollow core 130 is here replaced by a solid, shorter inner core 143. The weight of the inner core 143 must here be adapted to the density of the liquid in such a way that it cannot be pressed in the direction of the ribs 135, either by the liquid or by the pressure to which the latter is subject, but always rests on the ribs 135 when the device is held as shown in FIG. 18. Furthermore, it must be shorter than the internal length of the outer hollow core 128. When the device is now shaken in the axial direction, the inner core 143 moves coaxially in the outer hollow core 128, sucks in sediment particles 142 and liquid 139 via the orifice 134, when it rises in the direction of the ribs 136, and ejects both of them again when it drops in the direction of the ribs 135. Thus, turbulence is created in the sediment 142, and this is transmitted to the liquid 139, as a result of which intimate mixing of the two phases is accomplished. The remaining parts operate as described in FIG. 17.

Figure 19:
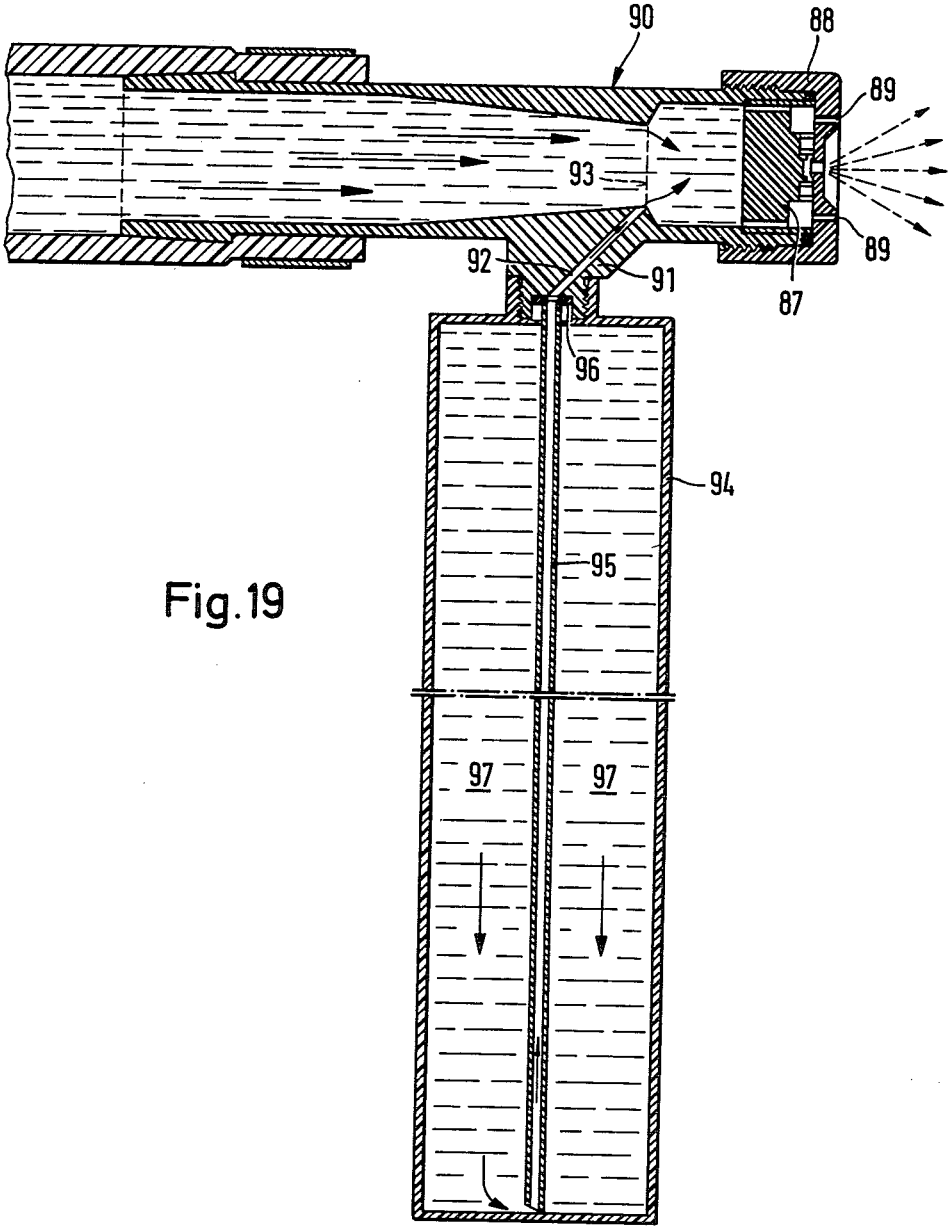
FIG. 19 shows, in longitudinal sectional view, a fire-fighting jet device having a spray nozzle according to the invention used therein.

FIG. 19 illustrates the use of a spray nozzle according to the invention in a fire-fighting jet. Although it is possible, due to the extremely high mechanical break-up which is achieved with the spray nozzle according to the invention (in particular when using such a nozzle as shown in FIG. 11), to generate a very fine water mist which can be made even finer if air is additionally admixed to the water, as described in FIGS. 13 to 15, there is scope for also admixing an extinguishing agent in addition to this already very effective method of fire-fighting. A spray nozzle according to the invention is screwed onto a fire-fighting jet body 90, the nozzle core 87 having the passages and annular chambers as shown in FIG. 11 and additionally also being provided with the inlet channels 29 of FIG. 13, which suck in air via the channels 89 of the nozzle case 88. The jet body 90 is provided with a screw-on branch 91 which has a bore 92 which points in such a direction that it opens into the jet body 90 just behind the constriction 93 therein so that a liquid flowing in the jet body 90 in the direction of the spray nozzle according to the invention exerts a suction effect on the bore 92 (Venturi-System). The screw-on branch 91 carries the container 94 and the riser tube 95 fixed thereto, the jet body 90 and the container 94 being joined together with sealing by means of a ring gasket 96. A fire-extinguishing agent 97, for example chlorobromomethane, is stored in the container 94. When pressurized water (for example under 6 to 10 atmospheres gauge) flows in the jet body 90, this water sucks in the fire-extinguishing agent 97 which is mixed with the water. As soon as this mixture comes into contact with the fire, the water, as a result of its high latent heat of vaporization, cools down the burning material and, since it is ejected from the fire-fighting jet as a fine mist due to the spray nozzle according to the invention, its large surface prevents a further access of oxygen to the burning material, whilst, for example, chlorobromomethane 97 enables an addition reaction of the oxygen still present with the CO molecules by means of the steam acting as a catalyst (Chemical Lexikon Rö mpp).

Instead of sucking in the fire-extinguishing agent via the device mentioned above, it is also possible to suck it in via the control valve 22 and the annular channel 26 of the spray nozzle according to FIGS. 14 and 15 and to mix it with the extinguishing water; this has the advantage that a very large container for the fire-extinguishing agent 97 can be used, which merely requires a flexible feed line to the inlet branch of the control valve 22.

FIGS. 20 to 24 show an internal combustion engine in which the spray nozzle according to the invention can be used for injecting a fuel (for example gasoline).

Figure 23:
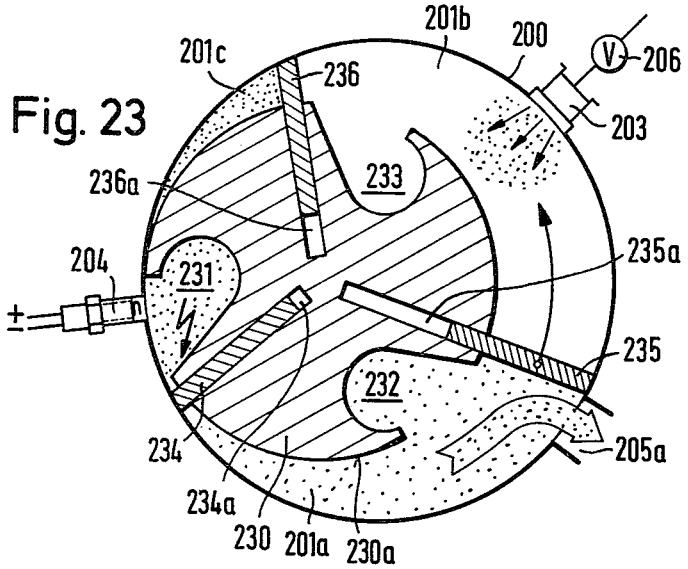
FIG. 23 shows a schematic cross-sectional view of a further embodiment of the rotary piston engine according to the invention, in a first working position of the piston.
Figure 24:
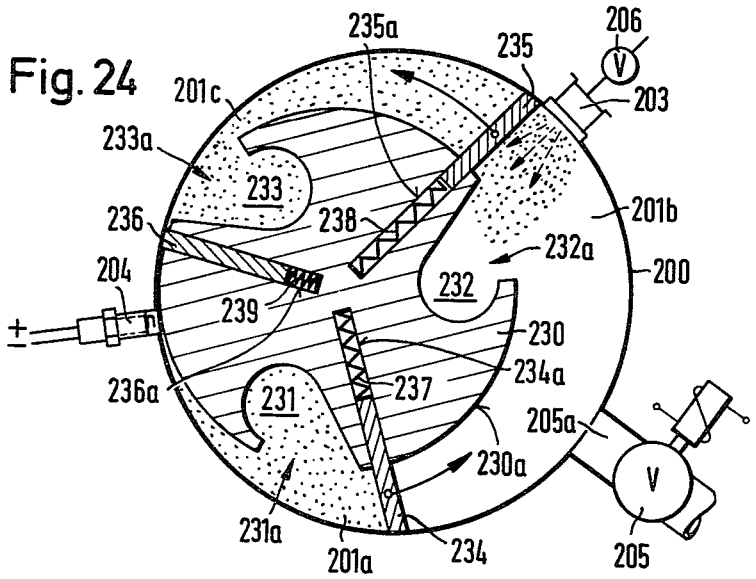
FIG. 24 shows a cross-sectional view of the same embodiment of the rotary piston engine as in FIG. 23, but in a subsequent working position of the piston.
Figures 25, 26:
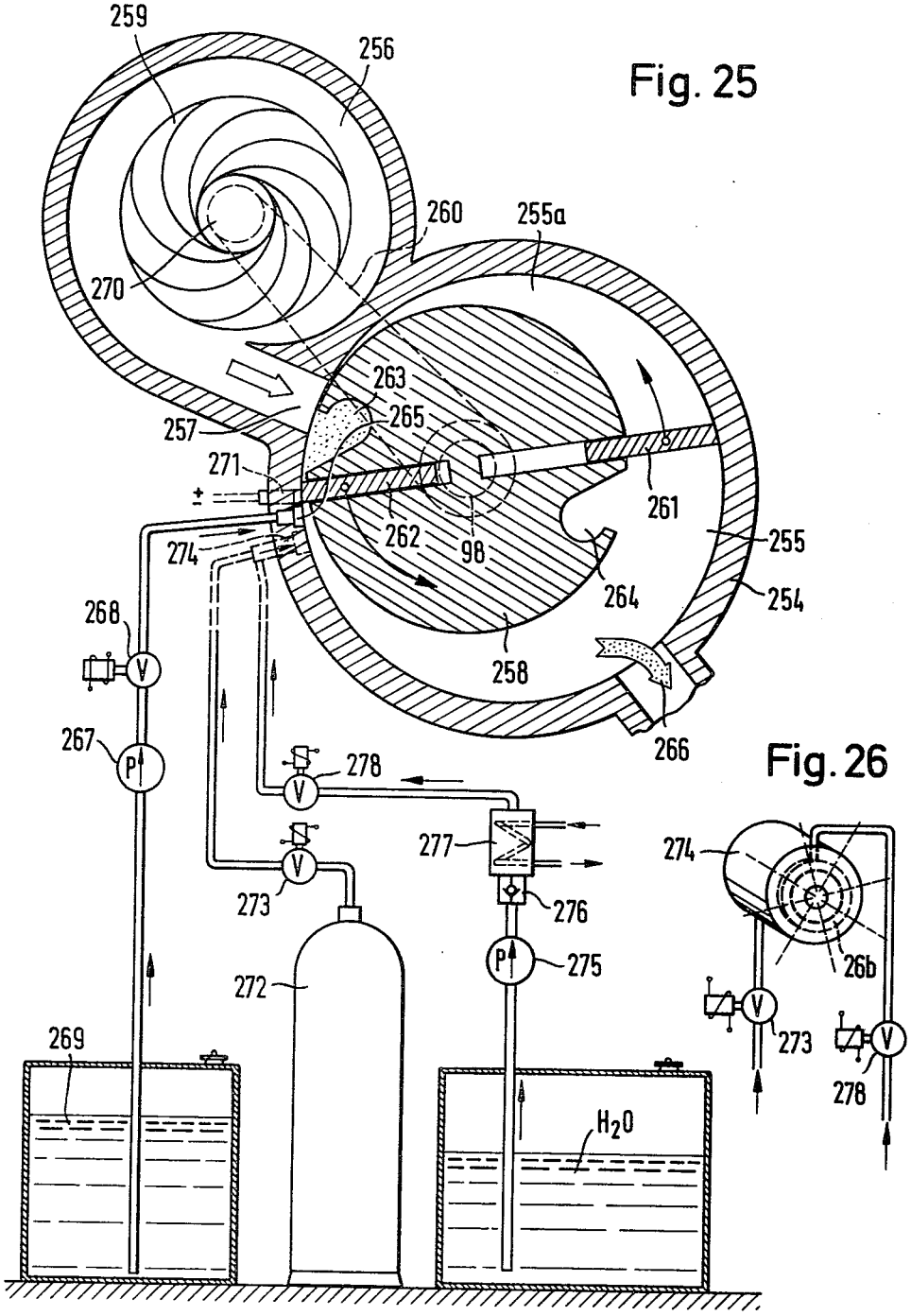
FIG. 25 shows a schematic cross-sectional view of a diesel engine according to the invention, with a schematic representation of its fuel supply.
FIG. 26 shows a perspective view of a spray nozzle according to the invention, as is used in a diesel engine according to FIG. 25.
Figure 27:
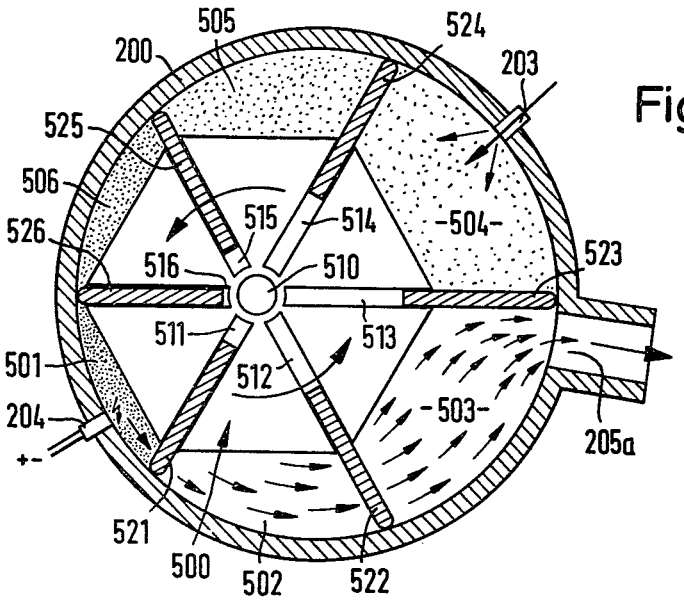
FIG. 27 shows a schematic cross-sectional view of an internal combustion engine somewhat similar to that shown in FIG. 23.

FIG. 25 shows a diesel engine with a schematic representation of its supply, and FIG. 27 shows, in a schematic representation, a rotary piston engine, containing the spray nozzle according to the invention, in accordance with one of FIGS. 20 to 25.

The fundamental concept for the use of the spray nozzle according to the invention in an engine is based on the fact that this nozzle has very good atomization properties even under a low gauge pressure and thus makes it possible to use a pressurized fuel, in which case it is possible to store this fuel in an oversized spray-can-like system, that is to say the system should have no pump and should be capable of operating without a carburetor. This has several advantages. Such an oversized "aerosol container" can contain, as the fuel, liquefied gas mixtures which just generate only such a pressure as is required for an optimum atomization by the spray nozzle according to the invention; a relatively thin-walled container could thus be used for storing the propellants and fuels. For example, liquefied butane and propane gas could be mixed in such a way that the mixture obtained generates a pressure of 6 atmospheres gauge in the aerosol container, which pressure is already four times that, under which the spray nozzle according to the invention is capable of delivering a very fine atomization. In addition to this butane/propane mixture which, additionally to its fuel properties, acts especially as a propellant gas, the aerosol container can contain gasoline, alcohol or other fuels which, mixed with the propellant gas and with its aid, are injected through the spray nozzle according to the invention into the cylinder of the engine with a very fine atomization, that is to say carburation. Since it is the aim nowadays, to get away from gasoline as a fuel, as far as this is possible, and since increasingly attempts are made to obtain biological energy sources, such as alcohol from plants having rapid growth, and to produce a gas, for example methane, by fermentation and putrefaction of organic residues, the use of liquefied gas, mixed with another fuel, in a system described below is particularly advantageous. In this case, only a liquefied gas should be used, and best a liquefied gas, the boiling point of which is held, if necessary by mixing with another gas, at such a level that the pressure generated is not excessively high and would require unduly thick container walls.

A second important problem is involved in using the system described below. Even if fuels, which do not pollute the environment, are used for supplying an engine, the latter should be used merely for generating electricity which drives a transport means via electric motors. It is known that batteries have only a limited range and are very heavy. On the other hand, however, electric motors have an efficiency of up to more than 90%, that is to say very much higher than a fuel engine, the efficiency of which corresponds to at most 40% depending on the quality and the manner of driving, and this is still further reduced by mechanical friction losses in a gearbox.

Therefore, a fuel engine of optimal efficiency should be used, which, however, always operates under the same conditions which are selected in such a way that it runs with the most ideal torque and then merely drives an electric generator which charges one or more batteries. Whenever possible, these batteries can be charged using cheap night current. The fuel engine would thus come into action only whenever the capacity of the batteries reaches a predetermined low point and not other possibility of charging, such as dynamos on driving downhill, braking and the like, is available.

Preference is given to a rotary piston engine since it represents a rotating energy source and it is thus not necessary in this case to convert the energy mechanically. Such a rotary piston engine is described in the following text by reference to FIGS. 20 to 26.

Figure 20:
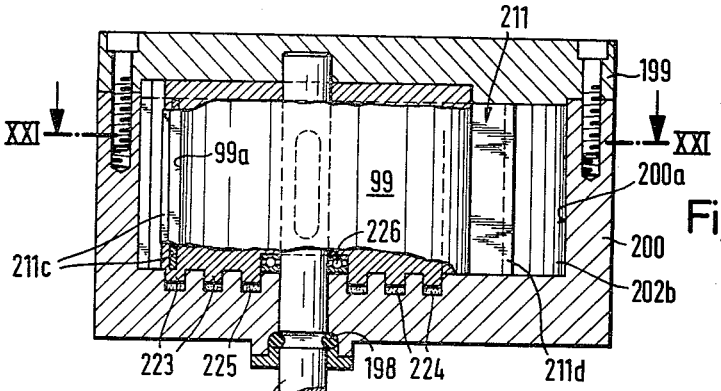
FIG. 20 shows an axial sectional view of a first embodiment of a rotary piston engine in which a spray nozzle according to the invention is used.
Figure 21:
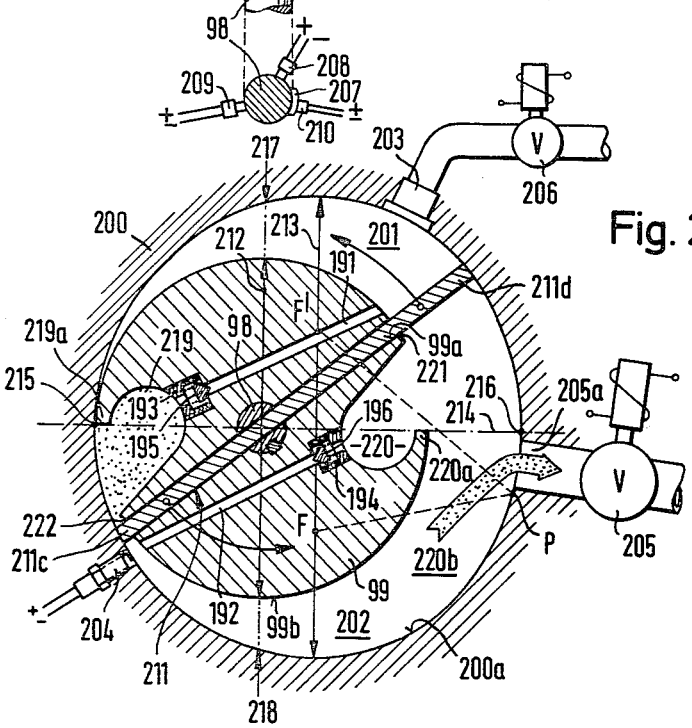
FIG. 21 shows a schematic view, partially in cross-section, of the rotary piston engine according to FIG. 20 along a plane indicated in FIG. 20 by XXI—XXI.
Figure 22:
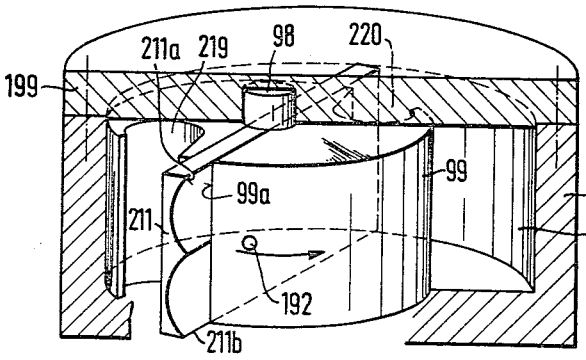
FIG. 22 shows a perspective view, partially in section, of the interior of the cylinder of the embodiment according to FIGS. 20 and 21.

In the embodiment of an internal combustion engine according to the invention, shown in FIGS. 20 to 22, the shaft 98 bears the rotary piston 99 excentrically in the cylinder casing 200. The piston 99 and the cylinder 200 are connected by a gland unit 198 as a seal. The cylinder casing 200 is hermetically closed by a cover 199. The spray nozzle 203 according to the invention, the spark plug 204 and the exhaust valve 205 are fitted in the inner peripheral wall 200*a* of the cylinder casing 200. The feed line to the spray nozzle 203 is opened and closed by a solenoid valve 206. To control the functions of the engine, the cam 207 on the axle 98 can, in passing, actuate the limit switches 208,209 and 210 by which the solenoid valve 206, the spark plug 204 and the solenoid valve 205 of the exhaust are switched on and off in this order.

Instead of limit switches, sliding contacts can be used, in which case the axle 98 is connected, likewise via a sliding contact, to a pole which is common with the other contacts. The rotary piston 99 carries a slider 211 which can shift in a transverse slot 99*a* extending through the center of piston 99 and the two ends of which are in sealing contact with the inner wall 200*a* of the cylinder 200 in any position.

This is only possible if the following is adhered to: The left half of the cross-section of the cylinder 200 is a hemicircle, the radius of which must be chosen larger than the radius of the piston sweep and is one half of the diameter 213. The center of the cylinder can thus be readily determined with the aid of contact point 215, between the inner wall 200*a* of cylinder 200 and the periphery of rotary piston 99, and of the center of piston 99. The length of the diameter 212 of the rotary piston 99 is measured and half this length is transferred to the diameter 213 of the cylinder 200 so that in each case one half of this half lies above the center and the other lies below the center. In this way, the focal points F and F' are obtained. The length of piston diameter 212 is then transferred to the diameter 214 (perpendicular to diameter 213), starting here at the contact point 215 between the rotary piston 99 and the cylinder 200. An ellipse is then drawn in the known manner, and the generating point P must run through the point 216. This gives an approximately circular arc (having half the cylinder diameter as the radius) between the points 217 and 218, going via 215, and an elliptical arc, going via 216. When the rotary piston 99 rotates, the slider 211 glides therein in such a way that both ends are always in contact with the inner wall of the cylinder 200. The rotary piston 99 is equipped with the explosion chambers 219 and 220. As viewed in the direction of rotation, these chambers are located a short distance behind the inlets 221 and 222 of the slot 99*a* in the rotary piston 99. Their height preferably is identical with that of the slider 211.

From the region of the cylindrical piston wall 99*b* located on the same side of the slider 211 as the explosion chamber 219 or 220, respectively, but relative to the latter on the opposite side of the piston, a duct 191 or 192, respectively, leads through the interior of the piston 99 to the respective explosion chamber and opens into the housing of a check valve 193 or 194, respectively, provided in the inner wall of the explosion chamber 219 or 220. A check valve body 195 or 196, respectively, is housed in the respective check valve 193 or 194. Its arrangement in the valve housing is known per se and is such that, in positions such as shown in FIG. 21 in which the internal cylinder space 201 which is located outside the explosion chamber 219 on the same side of slider 211 as chamber 219, and follows the explosion chamber 219 in the sense of rotation and is separated from the latter chamber by the contact made by the following wall edge portion 219*a* of chamber 219 with the inner cylinder wall 200*a* at the contact point 215 and for some time thereafter, whenever the pressure prevailing in the explosion chamber 219 is larger than the pressure prevailing in the above-mentioned separated internal cylinder space 201, then check valve body 195 will be urged against its seat in check valve 193 and the duct 191 will be sealed off from explosion chamber 219 in piston 99.

Whenever, on the other hand, the pressure in the following internal cylinder space 201 becomes larger than the pressure prevailing in the explosion chamber 219, then check valve 193 will be opened and pressure will be equalized via duct 191.

The same applies with regard to explosion chamber 220, the internal cylinder space 202 when separated from the former in or shortly after a position corresponding to that of chamber 219 shown in FIG. 21, and with regard to duct 192 and check valve 194 having check valve body 196.

Figure 13:
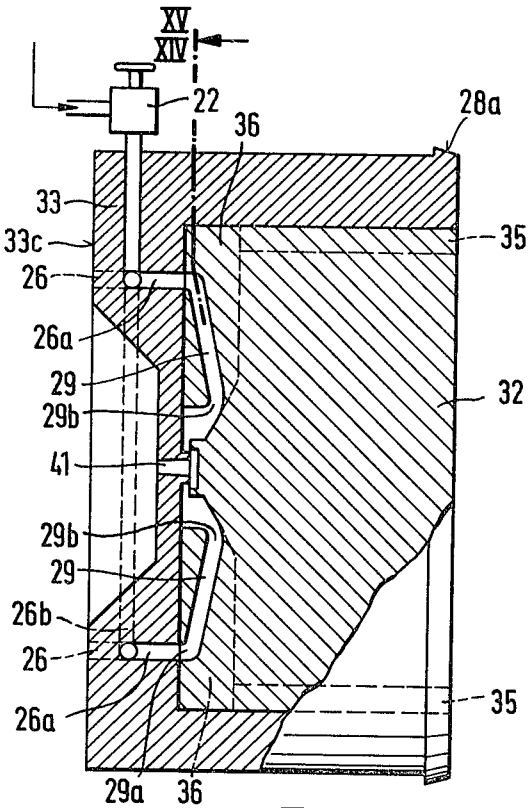
FIG. 13 shows in longitudinal sectional view an embodiment of the spray nozzle having a nozzle core as shown in FIG. 12 and an inlet valve and inlet ducts for a second medium.

The operation of this rotary engine is the following: when starting the engine with the aid of a starter 242 (FIG. 27) and as soon as the slider 211 has reached a position between points 215 and 216 (horizontally in FIG. 21), the exhaust valve 205 is closed and the nozzle-controlling solenoid valve 206 is opened and a fuel-air mixture is sprayed via nozzle 203 into the joint space of explosion chamber 219 and following internal cylinder space 201 for a brief period. The nozzle embodiment chosen for this purpose is that of FIGS. 13 and 14 and is supplied with gasoline through the main conduit 27 and the supply duct 35 under control by the valve 206, while air is sucked into the nozzle 203 via the inlets 26*a*, the annular channel 26 and the inlet channels 29 under control by the valve 22 (FIG. 13). The ratio of gasoline-/air is continuously controlled by a corresponding setting of the valves 206 and 22.

With continued rotation of the piston 99 about the shaft 98, the slider 211, increasingly projecting from the slot 99*a*, pushes the gasoline/air mixture, which has been completely gasified by the hot wall of the cylinder 200, in front of itself until the position of maximum compression of the explosion chamber 219, shown in FIG. 21, has been reached again.

In this position, the communication between explosion chamber 219 and internal cylinder space 201 is interrupted and, as rotation (arrows) progresses, the protruding slider portion 211*d* of slider 211 pushes compressed explosive mixture from the rapidly diminishing space 201 through duct 191 and with opening of check valve 193 into the explosion chamber 219. Shortly prior to or when reaching the position in which the slider 211 extends between points 217 and 218, the fuel-air mixture now under optimal pressure in the explosion chamber 219 and in the internal cylinder space preceding the latter and following the slider portion 211*c* is ignited by means of ignition plug 204.

As the explosion pressure component (projection) on the side wall of the explosion chamber 219 adjacent the slider 211 and on the slider portion 211*c*, which latter protrudes a short way from slot end 222, is larger than the projection on the wall of the explosion chamber 219 upstream of the latter there results a propellant component on the slider portion 211*c*, while the pressure of the explosion maintains check valve 193 closed. In the now following expansion phase, slider portion 211*d* pushes the last remainder of the fuel-air mixture from internal cylinder space 201 through duct 191 practically completely into the explosion chamber 219 where it is largely combusted, while the slider portion 211*c* continues to emerge further from piston 99.

As soon as slider portion 211*c* has passed exhaust opening 205*a*, after a rotation of the piston about approximately 150 degrees with accompanying working expansion, the exhaust valve 205 is opened and the major portion of the hot combustion gases will leave the explosion chamber 219 and the internal cylinder space 201 in communication therewith.

A unit for flushing with fresh air can be connected at this point, the size of the internal cylinder wall 200*a* providing sufficient space therefor.

When slider portion 211*c* has arrived at contact point 216, the explosion chamber 220 and internal cylinder space 202 in communication therewith will have arrived in the same position which has been described above with regard to explosion chamber 219 and its internal cylinder space 201. The injection and ignition are then repeated in the above-described manner, but in explosion chamber 220 and the internal cylinder space 202 following the same as the slider portion 211*d* which follows the explosion chamber 219 but precedes the explosion chamber 220 by a short distance, passes the contact point 215.

In order to achieve an adequate sealing effect between the rotary piston 99 and the cylinder 200, the rotary piston 99 is provided with ribs 223 which engage with the grooves 224 of the cylinder base; the distance between the front end of the ribs and the base of the grooves is here held constant by means of a ball bearing 226 on which the rotary piston rests. The interspace thus formed is filled with a lubricant 225, the flash point of which is sufficiently high so that it is not ignited and is also chemically stable. A suitable example is trichlorotrifluoroethylene which is resistant to acids, bases and oxidizing agents. The medium 225 is intended to act as a lubricant, but also as a sealing agent due to its inertia. The same seal can be provided in the cover 199 but is not shown.

The main sealing problem is presented by the slider 211 at its contact faces with the base and the inner wall of the cylinder 200 and the cover 199. FIG. 22 shows a solution of this problem. Since, evidently, the rotary piston 99 does not have to be made in one piece, it can be manufactured in such a way that a slider 211 can glide therein, which slider has a special surface which generates turbulence and which presses the gas stream which is to be compressed against the base of the cylinder 200 and the cover 199 in such a way that turbulence is generated there, which turbulence assists, like an air cushion, in sealing the slider edges 211*a* and 211*b* against the base and cover. These edges must form an acute angle so that the lowest possible mechanical friction results on rotation.

In the embodiment of an internal combustion engine according to the invention, shown in FIGS. 23 and 24, the rotary piston 230 has three explosion chambers 231, 232 and 233 which are uniformly distributed around the periphery of the piston 230 and which open by their orifices 231*a*, 232*a* and 233*a* in the outer wall 230*a* of the piston 230. Corresponding to the number of explosion chambers, the piston 230 is equipped with three sliders 234, 235 and 236 which are located, so that they can shift, in radial slots 234*a*, 235*a* and 236*a* of the piston. In the radial slots, compression springs 237, 238 and 239 can be provided which press the sliders 234, 235 and 236 against the inner wall of the cylinder 200 in particular for better sealing at low revolutions (starting). At higher revolutions, the centrifugal force exerted on the sliders is sufficient for a seal against the inner wall of the cylinder.

In the embodiment according to FIGS. 23 and 24, the cross-section of the cylinder can have the same shape as in FIG. 21, but it can also be circular.

When running, the fuel/air mixture, compressed to the highest degree in the explosion chamber 231 in the position according to FIG. 23, is ignited by means of the spark plug 204 and the piston is set in rotation in the direction indicated by the arrow P. The slider 235 then passes the exhaust orifice 205*a* and the slider 234 passes the spark plug 204 approximately simultaneously. The slider 234 now expels the major part of the burnt gases from the working region 201*a* through the exhaust.

When the slider 234 has now passed the exhaust orifice 205*a*, the slider 235 has in the meantime passed the injection nozzle 203 so that a fuel/air mixture can now be injected by the spray nozzle 203 into the explosion chamber 232 situated in the working region 201*a*. Simultaneously with these processes in the explosion chamber 231, the same working processes take place in the explosion chambers 232 and 233 in a correspondingly staggered order.

FIG. 25 shows a section through a diesel engine with the diagrammatic representation of its supply system, wherein a spray nozzle according to the invention is used. The cylinder casing 254 is sub-divided into the chambers 255 and 256 which are connected via the channel 257. The chamber 255 contains the rotary piston 258 and the chamber 256 contains the impeller 259. The axle, which is only indicated, of the rotary piston 258 drives the axle, which is only indicated, of the impeller by means of a chain or a toothed drive belt 260. The rotary piston 258 carries the sliders 261 and 262 which on rotation are driven from their seats by means of centrifugal force and are in sealing contact with the inner wall of the chamber 255 and, depending on the rotary position, this pushes them back again into the seat since the center of the rotary piston 258 is not in the center of the chamber 255. The rotary piston 258 is provided with the combustion chambers 263 and 264 which are arranged as already described. The chamber 255 is provided with a spray nozzle 265 according to the invention and with the exhaust 266. The pump 267 supplies the spray nozzle 265 with the fuel 269 through the solenoid valve 268. The working pressure of the pump 267 is selected so that it is capable of injecting the fuel 269 under a pressure higher than the compression pressure. In the case where it is intended to work with a compression pressure which is too low for a diesel engine, a spark plug 271 can be provided which is located in such a way that it ignites the explosive mixture at the position of the piston 258 in which the mixture is most highly compressed. The air required for compression is sucked in by the impeller 259 via its eye 270 and passed through the channel 257 into the chamber 263 or 264 shortly prior to injection of the fuel. The heat thus generated ignites the injected fuel 269 unless a spark plug 271 as described, is used.

In another system of supply, the air is introduced into the chamber 255 and compressed as described. The spray nozzle 274 according to the invention is supplied with fuel via a solenoid valve 273 from an over-sized aerosol container 272, as described infra. The pump 275 delivers water via the nonreturn valve 276 to the vaporizer 277 which generates steam at a temperature of more than 300° C.; this steam passes via the solenoid valve 278 (FIG. 26) into the annular channel 279 of a spray nozzle according to the invention in the embodiment shown in FIG. 13 and provides ignition due to its temperature and also further raises the compression pressure in chamber 263 or 264. Of course, it is not absolutely necessary that the point of injection corresponds to that of FIG. 25, but is should be at a point which, depending on the fuel, is the most favorable position for its highest degree of efficiency. This depends on the nature of the fuel and must be determined empirically.

In the embodiment of a rotary piston engine shown in FIG. 27, all parts identical with those shown in FIGS. 20 to 24 have been given the same reference numeral. Many of the details shown in the last-mentioned figures have been omitted for the sake of clarity.

The rotary piston 500 in this embodiment is, however, distinguished from the pistons of the embodiments described hereinbefore by having a hexagonal cross section. This piston is rotatably supported on its shaft 510 and bears six radial slots 511 and 516 which open out of the six corner edges of the hexagonal prism constituted by piston 500. In slots 511 to 516 there are housed sliders 521 to 526, corresponding in all details to the sliders 234, 235 and 236 shown in FIG. 23 and, as far as details of sealing are concerned these are the same as shown in FIGS. 20 and 22.

The operation of the engine is similar to that of the embodiment shown in FIG. 21. No explosion chambers are needed in this case, as the working spaces 501 to 506 become sufficiently small in size during rotation of the piston 500 to afford satisfactory compression of a fuel/air mixture in the position occupied by working space 501 in the phase illustrated in FIG. 27. In this phase, slider 526 is in its innermost position in slot 516, while slider 521 has already protruded a short distance from slot 511. As ignition by means of plug 204 takes place, the force of the explosion occurring in working space 501 pushes slider 521 in the direction of the arrows. At the same time expansion of the hot combustion gases takes place in working chamber 502, the burnt gases are expelled at the same time through exhaust 205 from working space 503; also, simultaneously therewith, fuel/air mixture is injected through spray nozzle 203 into working space 504 and compression of that mixture is in progress in working spacec 505 and 506. As the latter is moved to occupy the position of working chamber 501 in FIG. 27, plug 204 ignites the now maximally compressed fuel/air mixture in working space 506, and the work cycle is repeated, similar to that of a six stroke engine.

Figure 28:
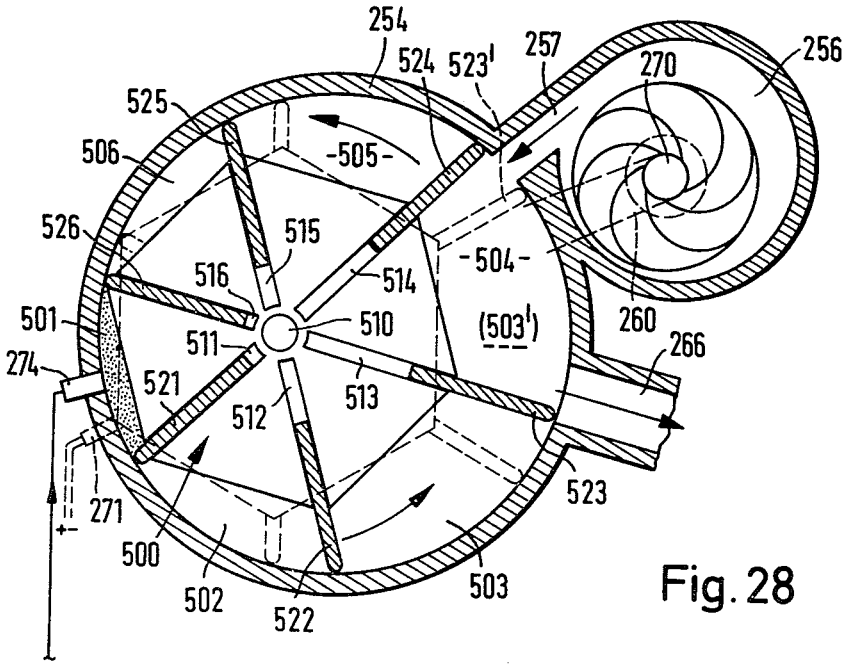
FIG. 28 shows a schematic cross-sectional view of a diesel engine, somewhat similar to that shown in FIG. 25.

In the embodiment of a diesel engine seen in FIG. 28, all parts identical with those shown in the embodiment shown in FIGS. 25 and 26 bear identical reference numerals, and all details omitted from FIG. 28 but represented in FIG. 25 should be incorporated by reference in the former and the description thereof in connection with FIG. 25 is referred to.

The rotary piston 500 in the embodiment of a diesel engine shown in FIG. 28 is identical with that shown in FIG. 27, and all parts pertaining thereto bear the same reference numerals as in the last-mentioned figure. The same applies to the working spaces 501 to 506 in which the following work phases occur.

As working space 504 passes through the position shown in FIG. 28, while piston 500 is rotated about its shaft 510, compressed air from compressor 256 flushes this working space briefly expelling waste gases into the open exhaust 266. Upon further rotation, slider 523 seals off working space 504 from exhaust 266 and compressor 256 fills this space with compressed air. The hot air is further compressed while passing through the positions occupied in FIG. 28 by working spaces 505 and 506, until it reaches the position of working space 501 in which fuel is injected into the working space from spray nozzle 274 according to the invention. Combustion occurs and the expanding explosion gases push the slider 521 in the case or working space 501, or 526 in the case of working space 506, until it passes through expansion phases in which working spaces 502 and 503 are to be found in FIG. 28. As working space 503 and sliders 523 and 522, respectively preceding and following it, have reached the positions indicated by 503' between dashed lines in FIG. 28, exhaustion of this working space is in full progress while slider 523 in its position 523' still prevents flushing of working space 503 by compressed air. The work cycle then repeats itself.

Figure 29:
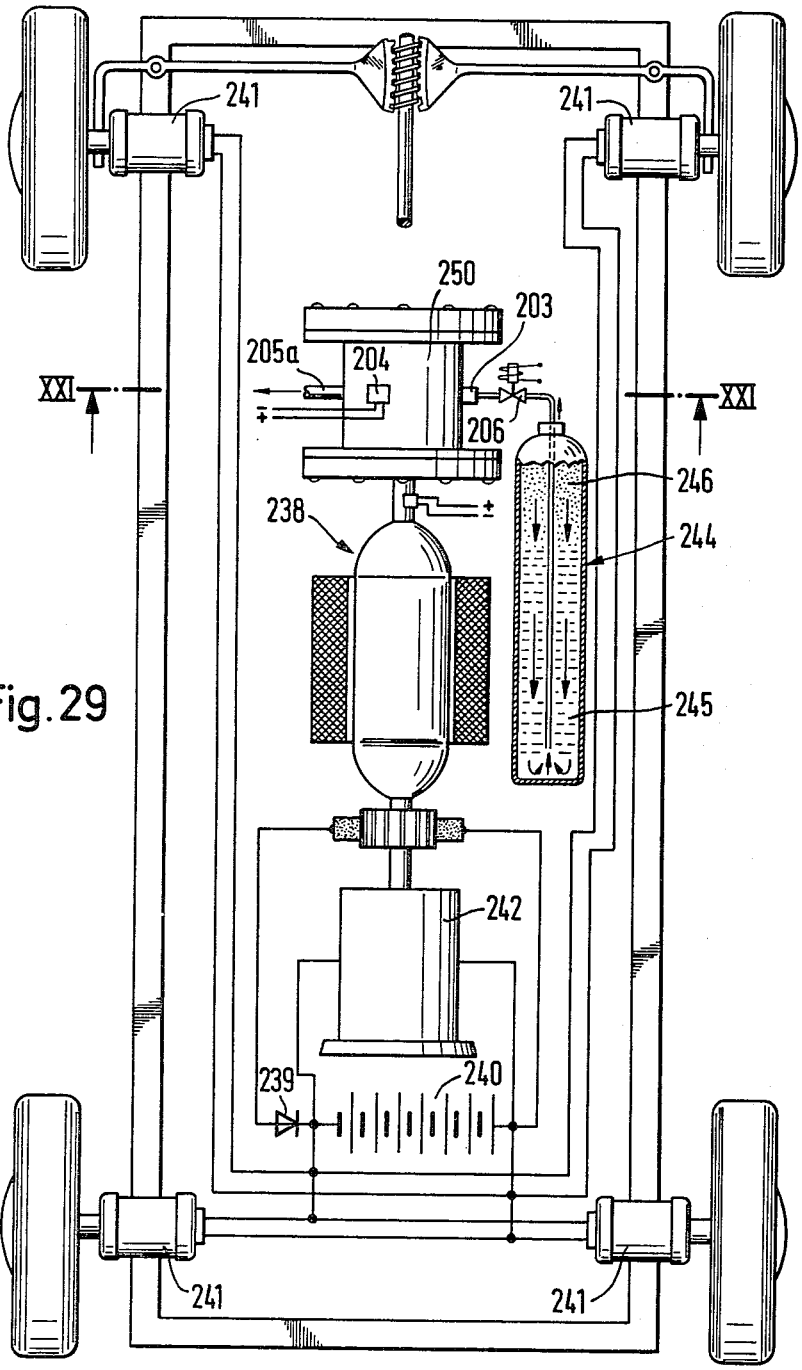
FIG. 29 shows a schematic representation, partially in perspective and partially in section, of an application of the internal combustion engine or diesel engine according to FIGS. 20 to 28, having the spray nozzle according to the invention, in an energy-saving transport device, which does not pollute the environment.

FIG. 29 diagrammatically shows a transport means which due to a spray nozzle according to the invention, can be provided with a fuel tank 244 which is equivalent to an over-sized aerosol container. The tank 244 contains a fuel mixture 245 which contains a liquefied gas and which, depending on the boiling point of the liquefied gas, forms such a quantity of gas phase 246 that a working pressure needed in the spray nozzle 230 according to the invention is reached. A rotary piston engine 250, which has already been described by reference to FIGS. 20 to 25, drives the electric generator (dynamo) 238. The latter supplies, via a diode 239, the battery 240 which in turn drives the electric motors 241. The starter 242 is provided for starting the engine 250. The other working parts, such as brakes, accelerator pedal, lights and the like, are not shown, since they are known. Moreover, an ammeter with limiters is likewise not shown; this switches the engine 250 on by means of the starter 242, as soon as the capacity of the battery 240 falls to a pre-set lowest level.

FIG. 30 shows a sectional view of a propellantless spray can according to the invention, filled with a liquid to be atomized. The valve unit required in the device comprises a core 301 made of plastic, which consists of two parts 301A and 301B. The part 301A is a container which is open at its upper end 308, whilst its lower end 304 is closed and advantageously has an ovoid shape. At its upper end, the part 301B of the core 301 has a seat 305 with a central channel 306, the lower end of which leads into a transverse channel 307. The upper end 308 of the part 301A tapers so that it can be joined to the lower end of the part 301B to give the complete core 301. Below the seat 305, the part 301B has two increases in thickness 309 and 310 as well as a tube-shaped connecting and sealing element 311 which advantageously consists of synthetic rubber of the polyacrylonitrile type, for example a compressible synthetic material, which be compatible with and inert to the product 312. The seal 311 seals a bag 313 which consists of a coated aluminum foil advantageously having four layers, namely polyester/aluminum/polyester/polyethylene or polypropylene, the last of which layers comes into contact with the product 312.

Advantageously, the bag 313 is produced by welding up an aluminum foil folded along the line 314 in FIG. 30A, welding having to be carried out along the seam 315. Around its outlet orifice 36, the bag 313 has a plurality of lamellae 317. This makes it possible to join the bag 313 firmly to the core 301 in the manner described below.

The base of the bag 313, which is represented by the fold line 314, should not be welded up but should be formed by the fold of a continuous laminated foil since the pressurized product 312 predominantly presses against the base of the bag 313 because the latter is surrounded by a rubber hose 318 which is open at its lower end 319 in FIG. 30.

The core 301, which carries the bag 313 together with the seal 311, is located inside the rubber hose 318. The latter is advantageously manufactured from virtually pure natural rubber which has a hardness of the order of 45° Shore.

The central channel 306 is shaped in such a way that it can receive a piston 320 which is provided with a transverse channel 321 and a central channel 322, the lower end of the latter leading into the transverse channel 321. Moreover, the piston 320 has several axial channels 320*a* which are separated from one another by axial ribs which end in extensions of fingers 323 which protrude into the cylinder formed by the central channel 306.

The gasket disk 324 has a central channel 325 having a diameter of such magnitude that the gasket disk 324, when it is placed around the piston 320, closes the orifices of the transverse channel 321 with great force. The gasket disk 324 lies in the seat 305 which has a shoulder 320*b* supporting gasket disk 324. The core 301, the bag 313, the hose 318, the seal 311, the piston 320 and the gasket disk 324 are held together by means of a case 326 and a ring 328 which bears against the lower peripheral zone of the case 326 and protrudes into a groove 327 on the inside thereof. These parts are held together in the following manner: the ring 328 has notches 330 in an upper ring part and an inner ring reinforcement 331. The latter is arranged in such a way that, when the parts are assembled, it will lie between the increases in thickness 309 and 310 of the core 301. The inside of the case 326 is conical so that its cavity 332 widens downwards. When the core 301, which carries the seal 311 is introduced into the bag 313, the lamellae 317 which are located around the outlet orifice 316 will lie like a crown below the seat 305 and, when this unit is introduced into the hose 318, the lamellae 317 will lie outside the hose 318 parallel to the axis of the core 301. After the piston 320 carrying the gasket disk 324 has been introduced into the central channel 306 of the core 301, the ring 328 is pushed over the hose 318 and the lamellae 317 for such a distance that it will lie against the seat 305 of the core 301, whereupon this unit is introduced into the case 326 in such a way that the part 322*a* of the piston passes into cavity 332 of the case 326. Since the cavity of case 326 is conical, the notches 330 in the ring 328 close in such a way that the lamellae 317, the hose 318, the bag 313, the seal 311 and the core 301 are firmly pressed against one another. The ring reinforcement 331 engages between the two increases in thickness 309 and 310 so that any axial movement between the various parts is made impossible. The reinforcement 329 on the ring 328 engages in the groove 327 of the case 326, which groove presses the gasket disk 324 against a ridge 305*a* of the seat 305 so that the unit becomes air-tight. Since the ring 328 presses against the seat 305 from below and the case 326 presses against the seat 305 from above, no displacement of the latter is possible.

Initially, attempts were made to assemble the unit in the same manner without the lamellae 317; however, this had the result that the pressure exerted by the product 312 on the base 314 of the bag 313 displaced the bag downwards towards the orifice 319 of the hose 318 so that the product 312 could emerge from the bag 313. The lamellae 317 prevent sliding of the bag 313 since the latter is firmly held at a plurality of points. The lamellae 317 can be omitted only if a gland is used.

A gland can be used for ensuring reliable operation of the device according to the invention if the product 312 must be sterilized at 120° C. or even 140° C., since the plastic material used for the case 326 and the gasket disc 328 can undergo a slight deformation at these temperatures so that it no longer exerts a sufficient clamping action.

The part 322*a* of the piston 320, which surrounds the central channel 322, carries an actuator 334 in which a spray nozzle 354 according to the invention with supply ducts 348 and 349 is inserted.

The atomizer unit described above is built into a can 335 which can be closed with a lid 336. Since neither of these two parts is subject to any pressure, they can be manufactured from thin, cheap plastics or even from cardboard. A recess 338 having an orifice 339 is provided in the base 337 of the can 335. Furthermore, the base 337 is provided with parts 340 which mark a position "O". A rotary part 341 which carries a rod 342 bearing an indicator mark and a leaf spring 343 are inserted into the recess 338. The rod 342 protrudes through the orifice 339 into the interior of the can 335, whereas the leaf spring 343 lies against the base of the can 335 so that the rod 342 presses at any time with a light pressure against the outside of the outer wall of the zone 318*a* of the hose 318. When the bag 313 is empty, the rod 342 assumes the position, indicated by dashes in FIG. 30, and the indicator is coaxial with the parts 340.

The introduction of the core 301 which carries the bag 313, into the hose 318 causes assembly problems since the assembly time must be as short as possible in mass production, without the quality of the assembled device having to suffer for this reason. On the one hand, these problems arise from the fact that the core 301 preferably has a diameter which is 75% larger than the internal diameter of the hose 318 and that the hose 318 made from rubber does not readily glide over the core 301 and the bag 313. On the other hand, the bag 313 must not be exposed to any load during the assembly of the unit. A first embodiment of a device, by means of which these problems can be solved, is explained by reference to FIGS. 31 to 34.

Before assembly, it is advisable that the rubber hose 318 is coated on the inside beforehand with silicone oil or a similar lubricant. The purpose of this is not only to cause it to glide more readily during the assembly process but also to prevent that it exerts friction on the bag 313 when the latter unwinds during the filling process, if it is wound around the core 301, for example as in FIG. 30A, or when the bag 313 unfolds if it is folded, the fold lines being parallel to the longitudinal axis of the bag 313.

Figure 31:
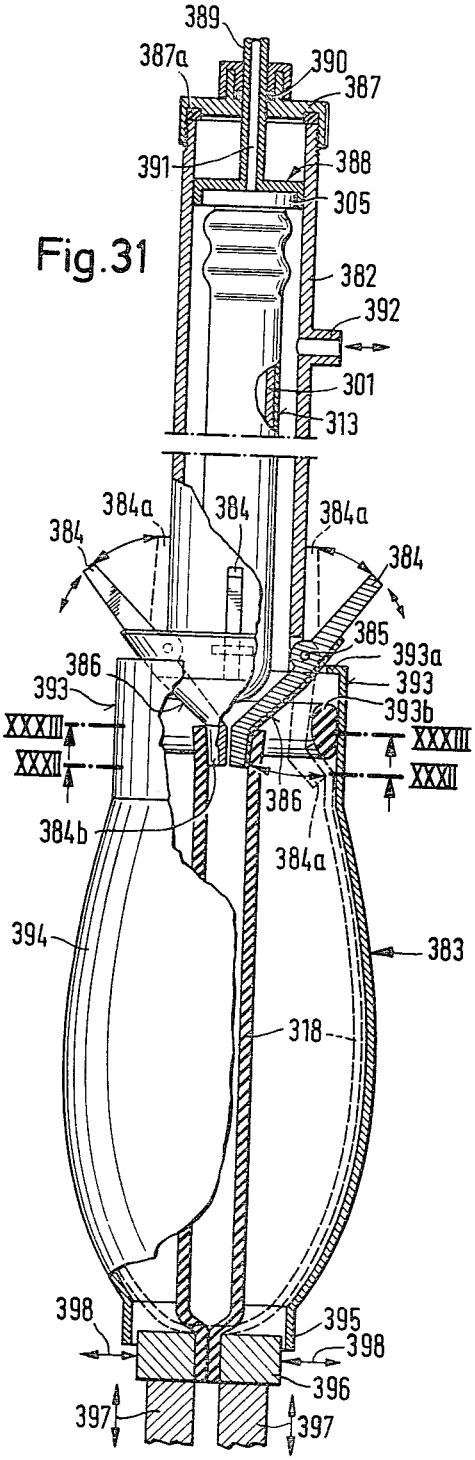
FIG. 31 shows in a front, partially axially sectional view, a first embodiment of an apparatus for automatically assembling the core with the bag fastened thereto, in an elastic hose element, in manufacturing a spray device according to FIG. 30.
Figure 33:
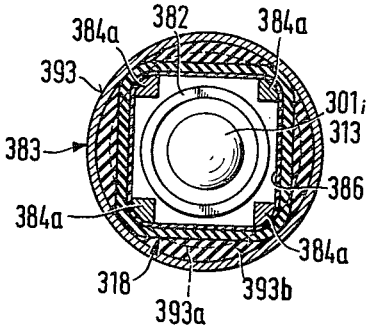
FIG. 33 shows a view from below of the apparatus shown in FIG. 31, with the assembled core, bag and hose element.
Figure 32:
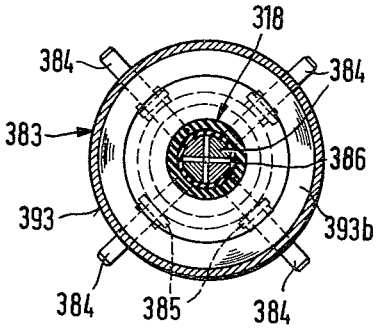
FIG. 32 is a plan view of a device for expanding the hose element in the apparatus shown in FIG. 31.
Figure 34:
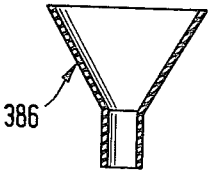
FIG. 34 shows an axial sectional view of a rubber seal within the apparatus shown in FIG. 31.

The assembling apparatus shown in FIG. 31 comprises a charging cylinder 382 and a limiting vessel 383. At that end of the charging cylinder 382 which is joined to the limiting vessel 383, the charging cylinder carries four levers 384 which are mounted so that they can rotate about axles 385. The levers 384 and the rotary shafts 385 lie inside a rubber sleeve 386. Moreover, the device has means which are not shown and which can move the levers 384 into the position 384*a* shown by broken lines. The upper end of the charging cylinder 382 is closed by a removable lid 387 which is sealed by means of a sealing element 387*a* and which carries a plunger 388 which can move in the axial direction. A rod 389 of the plunger 388 slides in a seal 390 and has a channel 391, through which a vacuum can be created in the charging cylinder by means of a vacuum pump which is not shown.

The charging cylinder 382 can be pressurized via a compressed air channel 392. The limiting vessel 383 has a cylindrical part 393 and an ovoid part 394. The cylindrical part 393 is shaped in such a way that it lies against the periphery of the rubber sleeve 318. The levers 384 are designed so that they do not strike the upper rim 393*a* of the cylindrical part 390 when they are moved into the position 384*a*. A gasket ring 393*b*, made from very flexible rubber, seals the rubber hose 318 against the rubber sleeve 386 by pressing against the expanded hose 318 and thus against the rubber sleeve 386. In the lower open end 395 of the limiting vessel 383 there is a clamp 396 which can clamp the lower open end of the hose 318 together and which can be moved together with the latter in the direction indicated by the arrows 397, whereas it can be moved for clamping or release of the hose 318 in the direction indicated by the arrows 398. A device which is not shown makes it possible to sever the hose 318 in the region of the clamp 396.

The assembling apparatus described works as explained hereinafter. The unit consisting of the core 301 and the bag 313 is introduced into the charging cylinder 382 in such a way that it will lie on the levers 384. Subsequently, the cover 387 is closed. The plunger 388 rests on the seat 305 of the part 301B of the core, forming a seal, so that the air present in the core 301 can be evacuated through the channel 390. On the one hand, the core 301 is thus held on the plunger 388 by the vacuum generated in this way and, on the other hand, the bag 313 wound around the core 301 is fixed in this position. At the same time, the levers 384 which are surrounded by the rubber sleeve 386 are introduced into the hose 318, the other end of which is in the clamp 396. The limiting vessel 383 is then pushed over the hose 318. The levers 384 are then brought into the position 384*a*, whereby the hose 318 is expanded. Compressed air is then blown into the device through the compressed air channel 392. As a result, the hose 318 is inflated axially and radially to such an extent that the plunger 388 can press the core 301, with the bag 313 wound thereon, downwards towards the clamp 396 into such a position that the core 301 will lie against the lower end of the hose 318 above the clamp 396. Thereafter, the compressed air is discharged through the compressed air channel 392 so that the hose 318 tries to return to its original position and contracts again axially and radially until it meets the bag 313 which is wound about the core 301. The levers 384 are then moved back into their initial position until their lower end 384*b* lie against the plunger 388 so that the upper end of the hose 318 will lie against the outside of the bag 313 and the upper end of the core 301. Subsequently, the vacuum present in the core 301 is relieved through the channel 391 and the clamp 396 is opened so that the lower end of the hose 318 is released, whereupon the limiting vessel 383 is pulled down away from the unit formed by the core 301, the bag 313 and the hose 318. At the same time, the levers 384 are moved back slightly towards the position 384*a* in order to release the plunger 388 which can be retracted. After the limiting vessel 383 has been pulled away from the rubber sleeve 386, a cutting unit which is not shown cuts off a superfluous upper part of the hose 318 along the lower edge of the plunger 388. When the plunger 388 is then pulled away upwards, the cut-off part of the hose 318, together with the unit formed by the core 301, the bag 313 and the remaining hose 318, drops out of the assembly device and the working cycle described can start anew.

Figures 35, 35A:
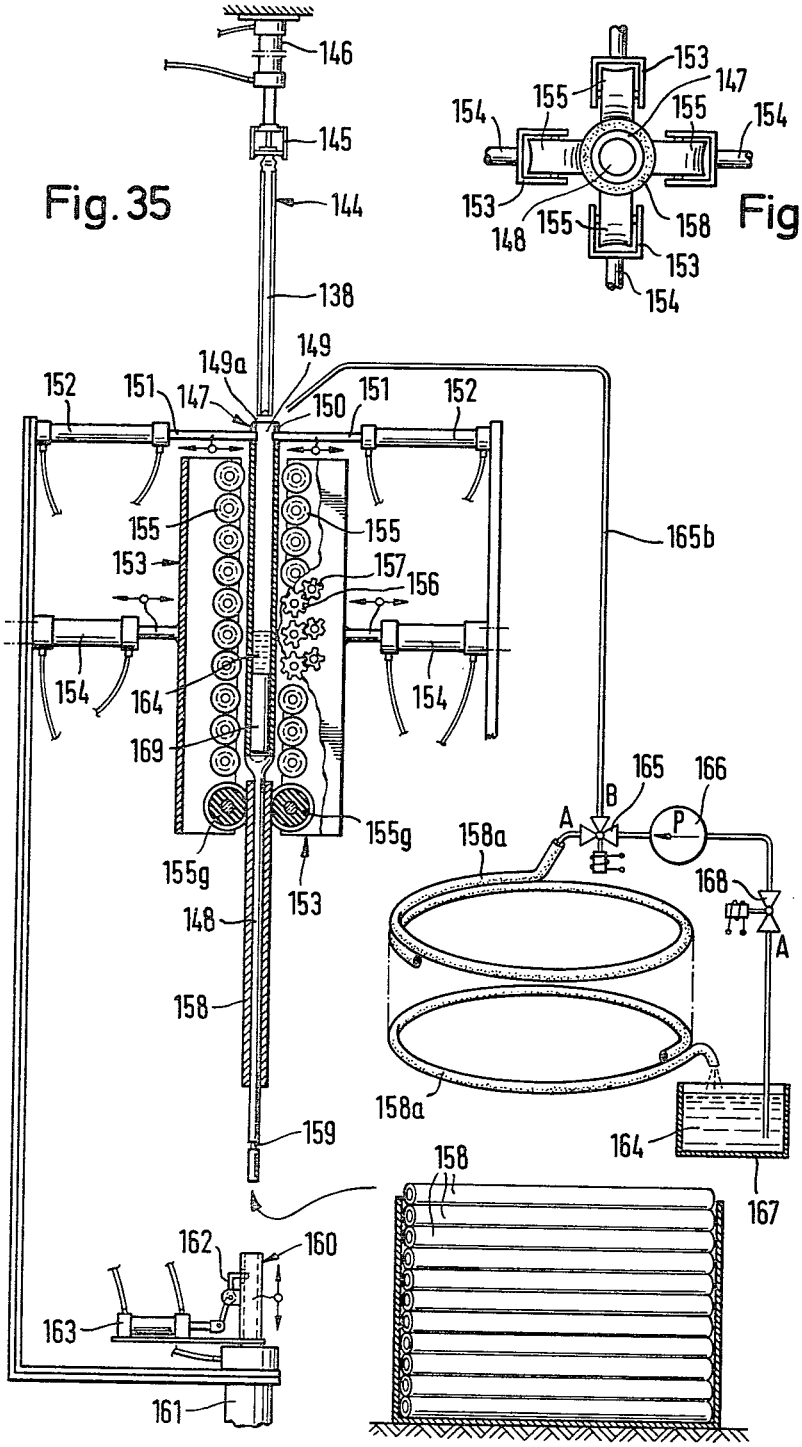
FIG. 35 is a schematic representation, partially in longitudinal sectional view, of a further preferred embodiment of the assembling apparatus serving for mounting the hose element used as an energy store.
FIG. 35A is a schematic front view of a part of the assembling apparatus shown in FIG. 35.
Figure 36:
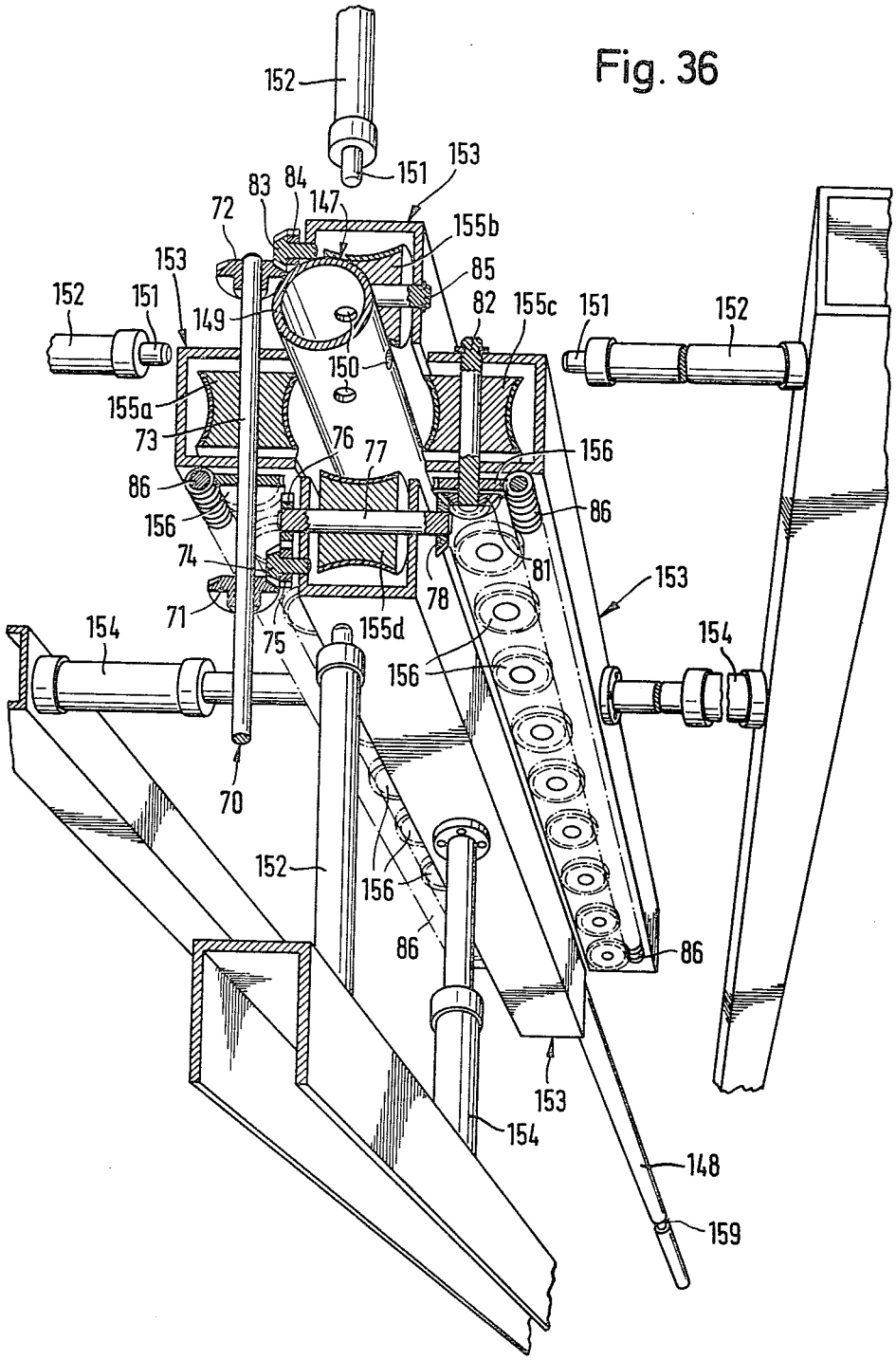
FIG. 36 shows a perspective view, partially in cross-section, of a part of the assembling apparatus shown in FIG. 35.

FIGS. 35 and 36 show, in a diagrammatic representation, a further preferred embodiment of the assembly device according to the invention for mounting the energy store on the valve part of the spray apparatus according to FIG. 17 or FIG. 30.

In the first embodiment of an assembling apparatus, shown in FIGS. 31 to 34, a relatively high rubber loss readily occurs, that is to say up to 2 grams of rubber can be lost per assembly step of each unit. In the embodiments of the assembling apparatus, described below, this is avoided. The pre-assembled valve part 144 is provided with the product container 138, resting thereon, and is held by the gripper 145 which is fixed to a two-way pressure cylinder 146. Coaxially below this, there is the push-out unit 147 which comprises the quiver 149 and the stem 148. At the inlet, the quiver 149 is provided with lateral orifices 150 in which the holding bolts 151 of the two-way pressure cylinders 152 engage and thus hold the quiver 149. Around the quiver 149, there are roller carriers 153 which are fixed to the two-way pressure cylinders 154. The roller carriers 153 contain the rollers 155, the axes of which are provided on one side with gears 156 which in turn are driven by gears 157. The drive means are not shown since they are conventional.

The rollers 155 are rubber-coated and are curved in such a way that they adapt by adhesion to the diameter of the rubber hose 158 pushed over the quiver 149; the distance between the quiver 149 and the rollers 155 is here adjusted by means of the pressure cylinders 154 in such a way that a rubber hose 158 present on the quiver 149 is firmly clamped in under pressure between the quiver 149 and the rollers 155. The quiver 149 continues in stem 148 which is provided with an annular groove 159. On an extension of the axis of the stem 148, there is the holding device 160 which consists of the two-way pressure cylinder 161, the catch 162 and the two-way pressure cylinder 163 coupled thereto. This holding device serves to carry the quiver 149 by means of the stem 148 when the holding bolts 151 disengage from the orifices 150; this means, however, that the holding device 160 moves over the stem 148 until the catch 162 engages in the annular groove 159. As soon as the holding bolts 151 again engage in the orifices 150, the two-way pressure cylinder 163 releases the catch 162 and the holding device 160 is pulled away from the stem 148 by means of the two-way pressure cylinder 161. Before the rubber hose 158*a* is cut up into hose pieces 158, it is coated on the inside with silicone oil. For this purpose, one end of the rubber hose 158*a* is connected via the outflow A of the three-way solenoid valve 165 to the pump 166 which sucks in silicone oil 164 from the container 167. The other end of the rubber hose 158*a* is connected to the container 167 so that the silicone oil 164 injected by the pump 166 into the rubber hose 158*a* can flow back again into its container 167. After the silicone oil 164 has flowed through the rubber hose 158*a* for a certain period, the way A of the three-way solenoid valve 168 closes, which opens the way B of this valve. The pump 166 no longer sucks in silicone oil 164, but instead it sucks in air which conveys excess oil from the rubber hose 158*a* to the container 167 so that the inner wall of the rubber hose 158*a* remains coated only with a film of silicone oil 164. The way B of the solenoid valve 165 is a pipe 165*b* which leads to the inlet of the quiver 149, by means of which silicone oil 164 is injected into the quiver, and specifically in just such an amount that the flexible product container 138 is coated with the silicone oil 164 by displacement when it is immersed into the quiver 149. In order to adapt the depth of the quiver to the length of the particular valve part 144, which depends on the filling volume of this spray apparatus, shortening rods 169 can be introduced into the quiver 149 for the purpose of reducing its volume.

The assembly device described above operates as follows: while the quiver 149 is held by the holding bolts 151, a predetermined amount of silicone oil 164 runs into the quiver 149 and the valve part 144 is then introduced into the quiver 149 by means of the pressure cylinder 146. At the same time, the piece of rubber hose 158 is pushed so far over the stem 148 that it is clamped in between the first rollers 155*g* which, since they rotate in the corresponding sense, move the hose 158 in the direction of the quiver 149. Simultaneously, the holding device 160 is moved over the stem 148, as a result of which the holding bolts 151 move away from the orifices. The valve part 144 is introduced so far into the quiver 149 that a distance of about 5 mm remains between the gripper 145 and the rim 149*a* of the quiver. As soon as the rubber hose 158, which is now conveyed by the rollers 155, arrives at the rim of the quiver 149 and is thus conveyed further, it penetrates into the annular gap between the gripper 145 and the rim of the quiver 149. At this instant, the pressure cylinder 146 starts to pull the valve part 144 out of the quiver 149; of course, this must take place at the same speed as that, with which the rubber hose 158 is moved by the rollers 155 so that the hose is laid around the valve part 144, which is being pulled out, and thus around the flexible container 138. As soon as the rubber hose 158 has been completely pushed off from the quiver 149, the holding bolts 151 engage again in the orifices 150, the holding device 160 moves away from the stem 148, silicone oil 164 is injected into the quiver 149, a new rubber hose 158 is pushed over the stem 148, a new valve part 144 is introduced into the quiver 149 and the process of assembling the rubber hose 158 over the valve part 144 together with the flexible container 138 proceeds again as described, and it will repeat itself continuously.

FIG. 36 is a perspective, partially cut view of the assembly device according to FIG. 35 and shows a preferred embodiment of the drive of the rollers 155. The drive shaft 70 is the axle of rotation of a motor which is not shown. It carries the splined gears 71 and 72 and simultaneously serves as the drive axle 73 of the roller 155*a*. The splined gear 71 engages with the splined gear 74 which has a common axle with the straight gear 75. The latter meshes with the straight gear 76 which drives the axle 77 of the roller 155*d*.

The axle 77 carries the splined gear 78 which engages with the splined gear 81 which drives the axle 32 of the roller 155*c*. At the end of the drive shaft 70, there is the splined gear 72 which engages with the splined gear 83 which has a common axle with the straight gear 84 which in turn drives the axle 85 of the roller 155*b* via a straight gear which is not visible. All the axles of the rollers 155*a–d* carry, on the outside of the roller carriers 153, gears which all engage with an associated screw. Since the first rollers 155*a*, 155*b*, 155*c* and 155*d* are drive rollers, as described, they drive the other rollers 155 by means of the associated straight gears 156 and screws 86 in such a way that they all have an identical direction of rotation and thus convey the rubber hose in the desired direction, as described.

Figure 37:
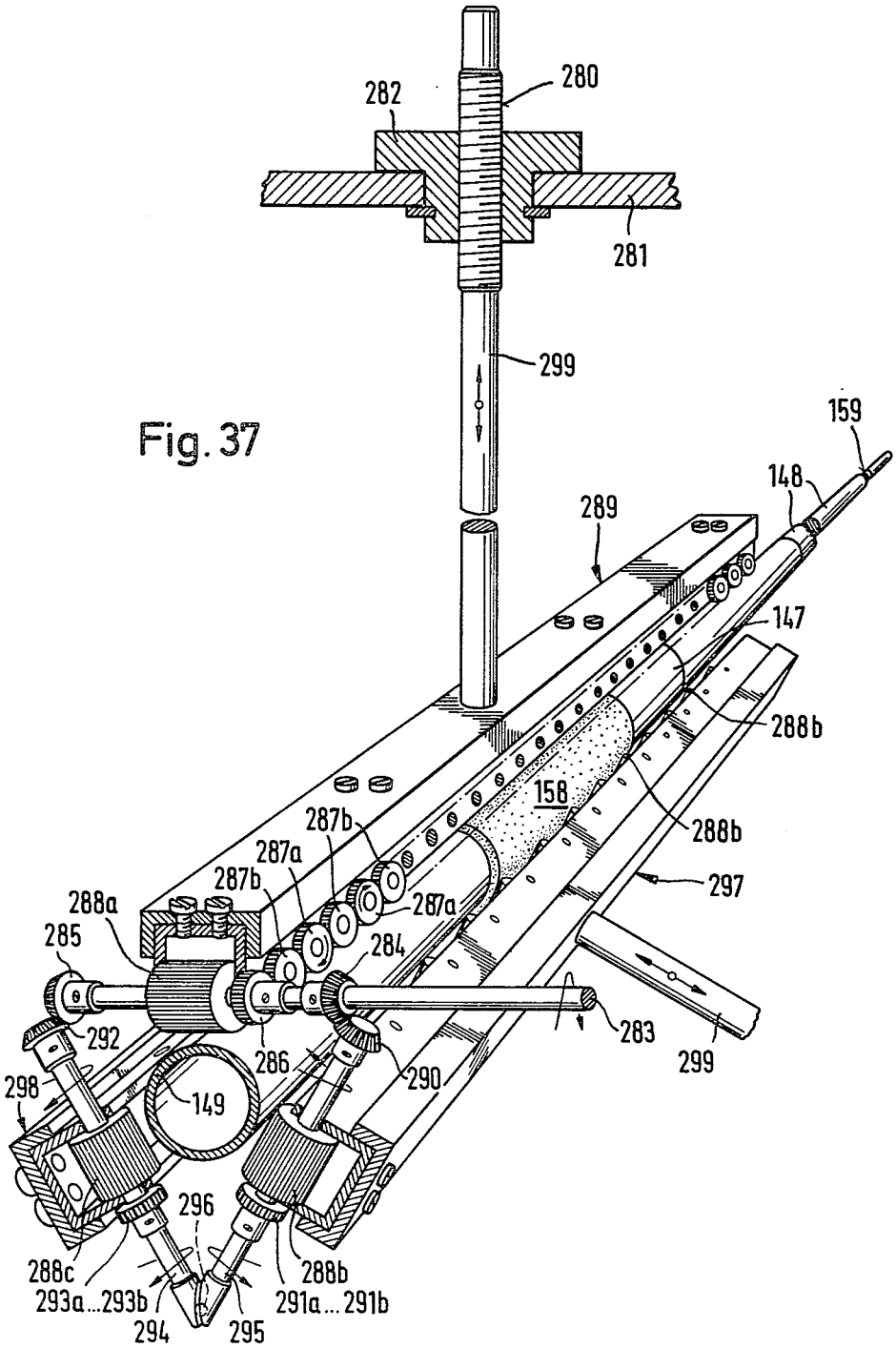
FIG. 37 shows in perspective part view, partially in cross-section, a third embodiment of an assembling apparatus for mounting the energy-storing element, similar to that apparatus shown in FIG. 36.

FIG. 37 shows in a perspective part view another embodiment of an assembly device according to the invention. The drive shaft 283 is the axle of rotation of a motor which is not shown. It carries the splined gears 284 and 285 as well as the straight gear 286 which drives the straight gears 287*a* and 287*b*. The drive shaft 283 is the axle driving a flanged roller 288*a*. The latter and subsequent flanged rollers, of which merely the gears 287*a* are seen, are mounted in the roller carrier 289. The gears 287*b* have the purpose of setting all the rollers 288*a*, with the gears 287*a* of which they are in engagement, into an identical direction of rotation. The splined gear 284 drives the splined gear 290 and thus the axle of the roller 288*b* which also drives the straight gear 291*a* which in turn sets all the rollers 288*b* into an identical direction of rotation by means of gears 291*b* which are not shown. The splined gear 292 is driven by the splined gear 285, which sets the roller 288*c* as well as the straight gear 293*a* in rotation. The remaining rollers 288*c* which are not shown are set into an identical direction of rotation by means of gears 293*b* which are not shown. The axles 294 and 295 have a common bearing block 296 which prevents a distortion of these two axles. The roller carriers 289, 297 and 298 are provided with the holders 299 which have a thread 280 which carries the nut 282 which in turn is rotatably connected to the frame part 281. With the aid of this device, the contact pressure of the rollers 288*a*, 288*b* and 288*c* can be varied and identically adjusted for each group of rollers. The quiver 147 with the stem 148 is identical to that of FIG. 35. Otherwise, this assembly device operates as already described above. However, it has the advantage that it requires only three roller carriers, which simplifies the drive. It should also be noted that the flanged rollers 288 are not convex but straight. Because of the smaller contact area on the quiver 147, this results in a reduced frictional resistance of the rubber hose 158 along the quiver 147.

Figure 38:
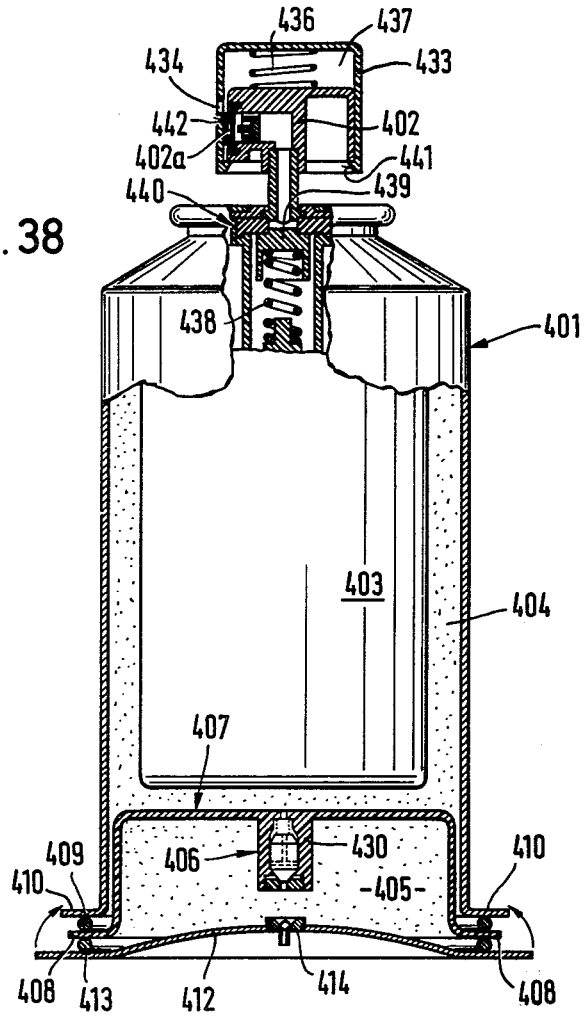
FIG. 38 shows a view, partially in axial section, of a two-compartment aerosol can.
Figure 39:
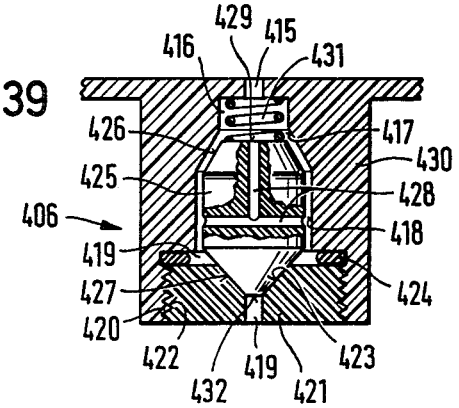
FIG. 39 shows an axial sectional view of a reducing valve as shown in the aerosol can of FIG. 38.

Finally, FIG. 38 now illustrates the use of the spray nozzle according to the invention in an aerosol spray can of known type and FIG. 39 illustrates a reducing valve which can be used therein. In a pressure container 401 which carries a spray nozzle according to the invention with a nozzle outlet 402*a* in an actuating head 402, there is the flexible product bag 403, from which product is discharged under control by the discharge valve 440, the gas pressure in the space 404, which pressure is kept constant by means of the pressure source 405 and with the aid of the reducing valve 406, acting on the product bag. The pressure source 405 consists of an overturned can 407, the base of which contains the seat of the reducing valve 406 and which is provided with the flange 408. The pressure source 405 is introduced into the pressure container 401 in such a way that the flange 408, which is provided with the seal 409, will lie on the flange 410 at the base end of the container 401. The base cover 412, which is made from the same material as the pressure container 401, carries the seal 413 and is crimped about the flange 410, so that it clamps in the flange 408 and the seals 409 and 413, which leads to a pressure-tight closure of the pressure container 401. The base cover 412 is provided with the non-return valve 414. With the aid of this arrangement, it is now possible to put the product container 403 under a constant pressure which is held at only such a level as is required for the quality of the particle size which is to be generated by the spray nozzle according to the invention, for example 2 atmospheres gauge. The pressure source 405 is thus filled with a medium which generates a correspondingly higher pressure so that the pressure thereof is capable of continuously compensating the pressure reductions, which arise from the volume changes of the product container 403, in the space 404 by the reducing valve 406, that is to say to keep the pressure in the space 404 constant. The reducing valve (FIG. 39) here operates as follows: the valve casing 430 is provided at one end with the orifice 415 which communicates with the chamber 416, the diameter of which widens inwards through the conical part 417, with a final transition into a hollow cylinder 418. The other end of the casing 430 shows the orifice 419 which is provided with the internal thread 420 into which the nut 421 is screwed in, the gasket ring 424 sealing the part 418 of the chamber. The casing 430 contains the piston 425 which is mounted in such a way that its conical end 426 can come into contact with the conical seat 417 and its conical end 427 can come into contact with the conical seat 423. In its interior, the piston 425 is provided with the duct 428, the axial branch of which ends in the center of the front face 429. The latter is supported by the helical spring 431 which presses the conical end 427 of the piston 425 against the conical seat 423. As soon as the pressure source 405 is put under a pressure which, of course, must be higher than the back-pressure of the spring 431, the piston 425 moves axially in such a way that its conical end 426 is pressed against the conical seat 417. The pressure of the pressure source 405 is thus propagated via the duct 428 into the pressure container 401. The surface of the front face 429 of the piston 425 is substantially larger than that of the cone tip 432 protruding into the orifice 419. Although the pressure in the space 404 is smaller than that of the pressure source 405, it is capable, due to the large surface 429 and the additional action of the spring 431, of moving the piston 425 axially back in the direction of the orifice 419, specifically whenever the pressure in the space 404 reaches the value, for which the surface 429 and the force of the spring were designed.

The abovementioned device can be manufactured very cheaply. The can 407 can be manufactured from a robust plastic material since it has to be gas-tight only to a limited extent because the pressure which may diffuse can indeed merely be propagated into the container 401, but it could not cause any substantial change of pressure in the latter. The casing 430 can be molded directly onto the base 407, so that this requires no assembly work. The piston 425 can likewise be manufactured from plastic; the same applies to the nut 421 which, in this case, needs to be merely a cover which can be high-frequency welded onto the casing 430, as a result of which the thread 420 would also be superfluous. It is not absolutely necessary that the spring 431 is present. The surface of the front face 429 can be calculated so that it serves as the area to which the pressure from the space 404 is applied. Of course, the cone surfaces 417, 423, 426 and 427 must be machined carefully, and these surfaces can be polished to a high gloss in the injection mold and can advantageously be chromium-plated. The piston 425 can, however, also be manufactured from a rubber material, the hardness of which is selected so that, due to the elasticity of rubber, small irregularities in the conical seats 417 and 423, such as can occur during the manufacture thereof as injection moldings, are filled, and this ensures the necessary tightness.

Pressure-reducing valves and their use together with a pressure source are known. The pressure-reducing valve described above, however, makes it possible to employ a particularly cheap means when using the spray nozzle according to the invention.

As described above, the spray nozzle according to the invention enables a satisfactory particle size and constant discharge rate to be guaranteed with a purely mechanical, low expulsion pressure. However, to prevent a pressure change caused by the volume change in the product container, the reducing valve described above and similar means must be provided in order to keep the pressure constant. The spray nozzle according to the invention can thus be used in exactly the same manner as is the case with known nozzles in the conventional aerosol spray cans. Most users of aerosol cans and other atomization devices neglect to replace an available protective cap over the spray nozzle after use. As a result, on the one hand, the nozzle gets easily covered with dust and, on the other hand, the spray nozzle can become blocked, especially in the case of hair lacquers and paint lacquers, when the carrier solvent evaporates and leaves a lacquer layer, which becomes thicker from use to use, in the interior of the channels and passages of the spray nozzle.

To avoid these defects, the spray nozzle according to the invention can be provided with a cap 433 which remains firmly joined to the spray nozzle 402 with the aid of a snap closure 441 and in the side wall of which an orifice 434 is provided. The side wall of the cap 433 covers the spray nozzle 402. A spring 436 accommodated in the interior space 437 possesses a substantially smaller force than the spring 438 which holds the valve body 439 of the discharge valve 440 in the maximum raised position, but it is sufficiently large to hold the cap 433 in the maximum raised position on the actuating head 402 when in the rest position, as a result of which the orifice 434 will lie at a height above the nozzle outlet 402*a* so that the nozzle outlet 402*a* is tightly covered by the side wall of the cap 433. In this way, both covering of the spray nozzle 402 with dust and evaporation of the solvent from the product, remaining therein after a spray operation, are prevented.

To orient their position relative to one another, the actuating head 402 and the cap 433 are either provided with guide rails or they have a non-circular outer or inner cross-section. Preferably, these cross-sections are, for example, oval or elliptical so that the orifice 434 is always vertically above the nozzle outlet 402*a*.

When a pressure is exerted on the cap 433 from above, the latter initially moves down until the spring 436 is compressed; as a result, the orifice 434 in the side wall of the cap is aligned with the nozzle outlet 402*a*. On pressing down further, the stronger spring 438 of the discharge valve 440 is also compressed and the valve 440 opens. As soon as the pressure on the cap 433 ceases, the stonger spring 438 first closes the valve 440 and, only after this, the weaker spring 436 lifts the cap 433 into the closing position in which the nozzle outlet 402*a* is again covered, a seal being formed, by the side wall of the cap below the orifice 434. A thin elastic coating 442 can be applied to the inner wall of the cap as a seal.

The new nozzle eliminates the use of a pump which not only requires repeated pressure for expelling the product but which also pumps surrounding air and thus oxygen into the product container, which naturally results in an undesired oxidation of the product.

The container wherein the product which is to be atomized by means of the spray nozzle according to the invention is stored, can without further measures be tight against air, spores, bacteria and other factors which can destroy the product, and it can also prevent, during storage, a volatilization of aroma substances contained in the product.

In the embodiments of FIGS. 17, 18 and 30, the element which stores the energy for expelling the product being stored in the container, is suitable for expelling the total product from the container uniformly and with linear consumption. It is designed so that the product can be stored for several months without a substantial part of the expulsion energy being lost during this period. The residual energy of the element suffices to expel the product completely from the container and to generate a spray mist, the particles of which are so fine that a product mist can be obtained even under unfavorable conditions, such as, for example, a low expulsion pressure.

In order to show the outstanding scope of the spray nozzle according to the invention in the best light, it may be mentioned that laboratory experiments have demonstrated that it is possible to save up to 75% of propellant gas in aerosol cans with the aid of this nozzle. In summary it should be stated:

(a) The spray nozzle according to the invention is capable of spraying a liquid, which is merely under a mechanical pressure, under only about 2 atmospheres gauge in the same quality as is attained by commercially available spray nozzles only under a pressure of 6 atmospheres gauge.

(b) In the case of aerosol spray cans, this means that the propellant gas no longer needs to serve as both the expulsion energy and the spraying factor as the result of its letdown in the surrounding air, but is now only intended to provide the pressure which is just sufficient fully to utilize the mechanical break-up properties of the spray nozzle according to the invention.

(c) This in turn has the consequence that it is no longer necessary to use a propellant gas mixture, such as Freon 11 and Freon 12, which was hitherto required to generate, on the one hand, a sufficiently large quantity of gas which serves as the spraying factor, and, on the other hand, to vary the expulsion pressure by means of different quantities of one or the other component of the gas mixture because of their very different boiling points, but instead, when the spray nozzle according to the invention is used, merely the propellant gas with the lowest boiling point can be employed and only such a quantity thereof can be used that an excess pressure of about 2 atmospheres gauge is reached in the aerosol can.

(d) Experience has shown that, for example in the case of hair lacquer, merely 19% of Freon 12, corresponding to a pressure of 1.7 atmospheres gauge, must be filled into the aerosol can, when the spray nozzle according to the invention is used, instead of 77% of the gas mixture of Freon 11 and 12, corresponding to a pressure of 3.8 atmospheres gauge, in order to reach identical spray qualities. The spray nozzle according to the invention also works with a pressure of 1.7 atmospheres gauge or even, depending on the drop size demanded, down to 0.8 atmosphere gauge, provided that this pressure is generated by a propellant gas. This is so because the propellant gas, after it has played its part as the source of expulsion energy, is let down, even though to a smaller extent, in contact with the surrounding air and thus compensates, as the spraying factor, the pressure fraction which makes up the difference to the 2 atmospheres gauge mentioned further above.

Laboratory experiments have also shown that, due to the mechanical break-up properties of the spray nozzle according to the invention, liquids which are forced through the nozzle under a high pressure, can be caused to evaporate due to the frictional heat being generated.

Conversely, it has been found that a liquid mixture having a boiling point below 40° C. can block the said passages, annular chambers and channels by freezing as a result of the formation of turbulence which starts in the interior of the spray nozzle according to the invention and because of the latent heat of vaporization thus absorbed.

It is therefore advisable only to spray liquids, the boiling point of which is above the limit mentioned.

To meet the objects stated above, it has been found that the most ideal energy store is a hose which consists of pure natural rubber and in which the product container is accommodated, that is to say a hose the hardness of which is 40° to 43° Shore and which thus delivers a pressure of between 0.6 and 0.8 atmosphere gauge per millimeter of wall thickness. However, since a wall thickness of at most 3 mm is to be used for reasons of price, volume, weight and manufacturing, a maximum pressure of 2.4 atmospheres gauge is thus available as the expulsion energy.

It must be taken into account here that rubber under tension is subject to an aging extension which leads to a reduction in wall thickness. The consequence is that the initial pressure, precisely because it depends on the wall thickness, decreases with the length of storage. This pressure loss can be compensated, also in other cases, with the aid of a pressure chamber according to FIG. 38 having a reducing valve according to FIG. 39.

I claim:

1. A spray nozzle for dispensing a liquid, which is subject to an elevated pressure, in form of a spray, comprising (A) a housing having a central nozzle outlet and a central nozzle axis therethrough, and an inlet opening for the nozzle outlet on the inside of the housing, (B) a hollow nozzle interior which is surrounded by a side wall and through which liquid flows towards the nozzle outlet, which interior comprises (a) a discharge chamber located upstream of the nozzle outlet on the inside and arranged coaxially with, and along a central plane perpendicular to, the central nozzle axis, (b) an annular chamber arranged coaxially to the discharge chamber, along a central plane perpendicular to the central nozzle axis, (c) at least two feed channels which extend from the annular chamber to the discharge chamber, in a plane intersecting the central nozzle axis and open at least approximately tangentially to the periphery of the discharge chamber, each feed channel having an inlet opening and an exit, the feed channels and the annular chamber forming a first stage of turbulence, and (d) at least one supply duct for feeding liquid to the first stage of turbulence and a supply line for the liquid to which said supply duct is connected, wherein the hollow interior of the nozzle further comprises (1) at least one additional stage of turbulence arranged coaxially to the discharge chamber, an outermost such additional stage comprising at least one outermost feed channel leading from said supply line to the annular chamber next-following downstream and opening into the last-mentioned annular chamber tangentially to the periphery of the latter, said outermost feed channel extending along a central plane substantially perpendicular to the central nozzle axis, and (2) on the side of the hollow nozzle interior, between a stage of turbulence which is upstream taken in the direction of liquid flow and the stage of turbulence which is immediately downstream thereof, at least one obstacle which serves to break up the liquid flowing from the upstream stage of turbulence to the downstream stage of turbulence and which deflects the flowing liquid out of a flow plane which flow plane extends through the annular chamber perpendicular to the central nozzle axis, towards the side of the nozzle outlet by an angle of up to 90°.

2. The spray nozzle of claim 1, wherein the break-up obstacle comprises at least one deflection or impingement surface which is opposed to the direction of flow.

3. The spray nozzle of claim 2, wherein one such additional stage of turbulence is interposed between the supply line and the annular chamber of the first stage of turbulence, the supply line comprising at least two supply ducts running in a substantially axial direction relative to the central axis of the nozzle and the additional stage of turbulence comprising at least two feed channels each having an inlet orifice and an outlet orifice, and extending along a course which gradually approaches the central axis of the nozzle in the direction of flow, said feed channels being each connected by its inlet orifice to one of the supply ducts and opening through its outlet orifice into the said annular chamber.

4. The spray nozzle of claim 2, wherein said impingement surface is provided at the mouth of a feed channel of an upstream stage of turbulence into an annular chamber of the additional stage of turbulence directly downstream thereof.

5. The spray nozzle of claim 1, wherein each of said annular chamber and feed channels has an outer top wall covering them, a bottom wall and an inner and an outer sidewall, with respect to the central nozzle axis, said obstacle comprises a deflection edge, which protrudes into the liquid flowing though the feed channels, in the region of the outer wall which covers the discharge chamber and surrounds the nozzle outlet, or in an inner wall region of the side wall of the nozzle interior.

6. The spray nozzle of claim 1, wherein said obstacle comprises a shoulder in the side wall of the nozzle interior, forming the impingement surface.

7. The spray nozzle of claim 6, wherein said shoulder is mounted on that region of the side wall of the nozzle interior which is remote from said nozzle outlet.

8. The spray nozzle of claim 6, wherein said shoulder is in the side wall of a feed channel and the flow cross-section of the latter feed channel upstream of said shoulder is larger than the flow cross-section of the same feed channel downstream of said shoulder.

9. The spray nozzle of claim 1, further comprising a peg-like projection having a front end and a sidewall tapered toward said nozzle outlet and containing at least one annular groove extending along a central plane perpendicular to the central nozzle axis, which projection protrudes from the bottom surface of the nozzle interior, opposite the nozzle outlet almost up to the inlet side of the nozzle outlet, at least one gap remaining free between the front end of this projection and the inlet opening of the nozzle outlet, which gap constituting a passage from the discharge chamber to the nozzle outlet, said annular groove constituting part of an annular chamber into which said obstacle projects.

10. The spray nozzle of claim 9, wherein said projection has a foot zone which is cylindrical and coaxial to the central axis of the nozzle, and wherein the distance of said front end, shaped as an end face, from the side wall, containing the inlet opening of the nozzle outlet, of the nozzle interior, is at most 0.1 mm.

11. The spray nozzle of claim 9, wherein said projection is tapered towards the nozzle outlet, and the distance of the front end of said projection from the inlet rim of the nozzle outlet is at most 0.05 mm.

12. The spray nozzle of claim 9, wherein said projection has a foot zone which is surrounded by the annular chamber of said first stage of turbulence, and a front end which abuts against the inlet opening of said nozzle outlet, and wherein said hollow interior comprises, between the front end of the projection and that wall region of the hollow interior in the nozzle housing which is in contact with said projection and contains the inlet opening of the nozzle outlet, at least two secondary ducts for liquid, each such secondary duct extending from the last-mentioned annular chamber to the nozzle outlet in a plane which intersects the central axis of the nozzle outlet.

13. The spray nozzle of claim 12, wherein the cross-section of the annular chamber, which extends around the peg-like projection and into which the feed channels of the outermost stage of turbulence lead, is larger than the cross-section of that annular chamber into which the feed channels of the next-following stage of turbulence lead, and the cross-section of the last-mentioned annular chamber is larger than that of the innermost annular chamber into which ducts lead from the next-preceding annular chamber.

14. The spray nozzle of claim 1, wherein the additional stage of turbulence comprises (a) an upstream annular chamber which is located at a larger distance from the discharge chamber than the annular chamber of the first stage of turbulence and which extends in the same zone, perpendicular to the central axis of the nozzle, as the first stage annular chamber or in a zone parallel to the latter, and (b) at least two feed channels leading from the upstream annular chamber inwards to the first annular chamber and opening into the latter at least approximately tangentially to the periphery thereof.

15. The spray nozzle of claim 14, wherein four supply ducts and four feed channels are arranged symmetrically to the central axis of the nozzle outlet.

16. The spray nozzle of claim 14, wherein the cross-sections of all feed channels and secondary passages decrease in the direction of flow, at least in their outlet regions.

17. The spray nozzle of claim 14, wherein the cross-section of the feed channels of each stage of turbulence continuously decrease from their inlet orifices in the annular chamber of the same stage of turbulence up to their outlet orifices located closer towards the nozzle outlet.

18. The spray nozzle of claim 14, wherein the feed channels of the first stage of turbulence extend along helices which run conically tapered toward the central nozzle axis.

19. The spray nozzle of claim 14, wherein the feed channels and any secondary passages present open into the annular chambers, located at their outlet orifices, tangentially to the peripheries of the respective annular chambers.

20. The spray nozzle of claim 14, wherein the outer walls of the feed channels and secondary passages tangentially merge with the peripheral walls of those annular chambers into which they open, whilst their inner walls run along tangents touching the outer walls of the last-mentioned annular chambers at the respective edge of each of the said inner walls with the outer walls of the last-mentioned annular chambers.

21. The spray nozzle of claim 20, wherein there are at least three concentric annular chambers and wherein the inlet orifice of each subsequent feed channel is in the inner wall of the preceding annular chamber at a short distance before the next upstream feed channel opens into the latter annular chamber, and the inlet orifice of each subsequent feed channel is located in the inner wall of the last-mentioned annular chamber at a short distance before the feed channel which is upstream in the sense of flow opens via its exit into the latter annular chamber, the cross-section of each subsequent feed channel decreasing continuously from its inlet orifice up to its exit opening out into the downstream annular chamber.

22. The spray nozzle of claim 14, wherein the flow cross-section of at least one of the annular chambers decreases in that portion of the annular chamber which extends from a point immediately downstream of the exit thereinto, of the feed channel which is next in the direction of flow and which leads from the outside into the same annular chamber.

23. The spray nozzle of claim 14, wherein the inlet orifices of the feed channels of a downstream stage of turbulence in the inner side wall of the annular chamber located ahead of this stage of turbulence are offset with respect to the exits of the feed channels of the preceding stage or turbulence leading into the last-mentioned annular chamber, upstream against the direction of flow of the liquid flowing into this annular chamber through the last-mentioned feed channels, and within the same reach as the respective last-mentioned exits.

24. The spray nozzle of one of claims 22 and 23, further comprising inlet ducts for a second medium, each of which leads through from the outer wall of the nozzle housing into the last-mentioned annular chamber.

25. The spray nozzle of claim 24, wherein each of the inlet ducts for a second medium from the outer wall of the nozzle housing into the outermost annular chamber opens through an exit located between the exits of two adjacent feed channels opening into the last-mentioned annular chamber through the outer peripheral wall of the latter.

26. The spray nozzle of claim 25, wherein each of said inlet ducts opening between the mouths of two adjacent feed channels from the outside into the annular chamber leads into the latter tangentially to the direction of flow through the annular chamber.

27. A nozzle carrier head adapted for having, in the outer wall thereof, an inserted spray nozzle comprising (A) a housing having a central nozzle outlet and a central nozzle axis therethrough, and an inlet opening for the nozzle outlet on the inside of the housing, (B) a hollow nozzle interior which is surrounded by a side wall and through which liquid flows towards the nozzle outlet, which interior comprises (a) a discharge chamber located upstream of the nozzle outlet on the inside and arranged coaxially with, and along a central plane perpendicular to, the central nozzle axis, (b) an annular chamber arranged coaxially to the discharge chamber, along a central plane perpendicular to the central nozzle axis, (c) at least two feed channels which extend from the annular chamber to the discharge chamber in a plane intersecting the central nozzle axis and open at least approximately tangentially to the periphery of the discharge chamber, each feed channel having an inlet opening and an exit, the feed channels and the annular chamber forming a first stage of turbulence, and (d) at least one supply duct for feeding liquid to the first stage of turbulence and a supply line for the liquid to which said supply duct is connected, wherein the hollow interior of the nozzle comprises (1) at least one additional stage of turbulence arranged coaxially to the discharge chamber, an outermost such additional stage comprising at least one outermost feed channel leading from said supply line to the annular chamber next-following downstream and opening into the last-mentioned annular chamber tangentially to the periphery of the latter, said outermost feed channel extending along a central plane substantially perpendicular to the central nozzle axis, and (2) on the side of the hollow nozzle interior, between a stage of turbulence which is upstream taken in the direction of liquid flow and the stage of turbulence which is immediately downstream thereof, at least one obstacle which serves to break up the liquid flowing from the upstream stage of turbulence to the downstream stage of turbulence and which deflects the flowing liquid out of a flow plane which flow plane extends through the annular chamber perpendicular to the central nozzle axis, towards the side of the nozzle outlet by an angle of up to 90°, wherein said supply line comprises at least two supply ducts extending substantially parallel to said central nozzle axis; said carrier head comprising a main conduit for liquid to which the supply ducts are connected, wherein the axis of the main conduit intersects the central axis of the nozzle outlet, the main conduit has a blind end on an inner wall of the nozzle carrier head, at least a first one of said supply ducts has its inlet orifice for liquid close to the blind end of the main conduit and at least a second one of said supply ducts has its inlet orifice for liquid at a larger distance from the said blind end, and wherein the main conduit, between the inlet orifice of the second supply duct and that of the first supply duct, has a shoulder, projecting into the main conduit, from the inner wall of the nozzle carrier head, the first supply duct extending through said shoulder being longer than the second supply duct.

28. The nozzle carrier head of claim 27, wherein the transverse surface of the shoulder which runs transversely to the axis of the main conduit, meets at an acute angle with the side wall of the main conduit, in which latter wall the inlet orifice of the second supply duct is located, and said shoulder surface extends from the vertex of the last-mentioned angle facing toward the inlet orifice of the second supply duct up to a common edge with that part of the wall of the main conduit which contains the inlet orifice of the first supply duct.

29. The nozzle carrier head of claim 28, wherein said main conduit has a first zone which leads from the said edge up to the inlet orifice of the first supply duct and which ends in the said blind end on the inner wall of the nozzle carrier head and a cross-section which, relative to the longitudinal axis of the main conduit, is larger than that of the second zone of the main conduit, which meets the transverse surface of said shoulder, the ratio of (a) the acute angle of inclination of the transverse surface of the shoulder relative to the said longitudinal axis, to (b) the acute angle of inclination of the inner wall of the nozzle carrier head, which represents the blind end of said first zone of the main conduit, relative to the same longitudinal axis, being proportional to the ratio of the cross-section of the first zone to the cross-section of the second zone of said conduit.

* * * * *